US006219496B1

(12) United States Patent
Kojima et al.

(10) Patent No.: US 6,219,496 B1
(45) Date of Patent: Apr. 17, 2001

(54) IMAGE FORMING APPARATUS

(75) Inventors: Takeo Kojima; Susumu Imado; Ryouhei Iwasaki; Hirofumi Nakayasu, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/464,450

(22) Filed: Dec. 16, 1999

(30) Foreign Application Priority Data

Dec. 18, 1998 (JP) ..... 10-361680

(51) Int. Cl.[7] ..... G03G 15/01

(52) U.S. Cl. ..... 399/43; 399/44; 399/66; 399/301; 399/394

(58) Field of Search ..... 399/66, 43, 298, 399/299, 301, 303, 38, 394, 396, 44, 94

(56) References Cited

U.S. PATENT DOCUMENTS 5,325,154 * 6/1994 Tayama et al. ..... 399/301
5,828,925 * 10/1998 Yoshizawa ..... 399/394 X
5,907,741 * 5/1999 Matsuzawa et al. ..... 399/299 X

FOREIGN PATENT DOCUMENTS 6-270387 9/1994 (JP) .
8-101554 4/1996 (JP) .
9-171275 6/1997 (JP) .
9-281871 10/1997 (JP) .
10-213943 8/1998 (JP) .

* cited by examiner

*Primary Examiner*—Sophia S. Chen
(74) *Attorney, Agent, or Firm*—Armstrong, Westerman, Hattori, McLeland & Naughton, LLP

(57) ABSTRACT

An image-forming device such as a full color printer is provided which is designed to correct the speed of a conveyer belt on which print sheets are transported or intervals between image-transferring units for compensating for a shift between colors. The image-forming device has a timer which measures an elapsed time from turning on of the device or release of a sleep mode, a print-off time and a print time and determines a correction value as a function of the times measured by the timer by look-up using a table.

27 Claims, 17 Drawing Sheets

FIG.22

| NO. | ELAPSED TIME FROM START OF BELT MOVEMENT | SPEED CORRECTION VALUE |
|---|---|---|
| 1 | 0~T1 | A0' |
| 2 | T1~T2 | A1 |
| 3 | T2~T3 | A2 |
| ~ | ~ | ~ |
| 16 | T15~T16 | A15 |
| 17 | T16~∞ | 0 |

FIG.23

| NO. | PRINT-OFF TIME | ELAPSED TIME FROM START OF BELT MOVEMENT |
|---|---|---|
| 1 | 0~U1 | W0 |
| 2 | U1~U2 | W1 |
| 3 | U2~U3 | W2 |
| ~ | ~ | ~ |
| 16 | U16~ | 0 |

FIG.24

| GROUP NO. | PRINT TIME (SEC.) | | | | PRINT-OFF TIME (MIN.) | | | | | |
|---|---|---|---|---|---|---|---|---|---|---|
| | MONO | COLOR | THICK PAPER | OHP. | 0~2 | 2~7 | 7~15 | 15~25 | ~ | 90~ |
| 0 | 0~2 | ~3 | ~4 | ~6 | 0 | 0 | 0 | 0 | 0 | 0 |
| 1 | 2~4 | 3~6 | 4~8 | 6~12 | | | | | | |
| 2 | 4~7 | 6~9 | 8~13 | 12~19 | | | | | | |
| 3 | 7~9 | 9~13 | 13~18 | 19~26 | | | | | | |
| 4 | 9~12 | 13~17 | 18~23 | 26~34 | | | | | | |
| 5 | 12~15 | 17~21 | 23~29 | 34~42 | | | | | | |
| 6 | 15~18 | 21~26 | 29~35 | 42~52 | 4 | 2 | 1 | 0 | 0 | 0 |
| 7 | 18~21 | 26~32 | 35~42 | 52~63 | 4 | 3 | 1 | 0 | 0 | 0 |
| 8 | 21~25 | 32~38 | 42~50 | 63~75 | 5 | 3 | 1 | 0 | 0 | 0 |
| 9 | 25~30 | 38~45 | 50~59 | 75~89 | 6 | 4 | 1 | 0 | 0 | 0 |
| 10 | 30~35 | 45~53 | 59~70 | 89~105 | 7 | 4 | 2 | 0 | 0 | 0 |
| 11 | 35~42 | 53~63 | 70~84 | 105~125 | 7 | 4 | 2 | 0 | 0 | 0 |
| 12 | 42~50 | 63~76 | 84~101 | 125~151 | 8 | 5 | 2 | 0 | 0 | 0 |
| 13 | 50~63 | 76~94 | 101~125 | 151~188 | 9 | 5 | 2 | 0 | 0 | 0 |
| 14 | 63~83 | 94~125 | 125~167 | 188~250 | 9 | 5 | 2 | 0 | 0 | 0 |
| 15 | 83~ | 125~ | 167~ | 250~ | 10 | 6 | 2 | 0 | 0 | 0 |
| | | | | GROUP NO. | 0 | 1 | 2 | 3 | ~ | 15 |

FIG.25

| PRINT-OFF TIME GROUP NO. | PRINT-OFF TIME COUNT (MIN.) |
|---|---|
| 0 | 2 |
| 1 | 7 |
| 2 | 15 |
| ~ | ~ |
| 15 | 90 |

FIG.26

| | | PRINT-OFF TIME GROUP NO. | | | |
|---|---|---|---|---|---|
| | | 0 | 1 | ~ | 15 |
| PRINT TIME GROUP NO. | 0 | PRINT TIME INITIAL VALUE A0 | PRINT TIME INITIAL VALUE B0 | ~ | PRINT TIME INITIAL VALUE F0 |
| | 1 | PRINT TIME INITIAL VALUE A1 | PRINT TIME INITIAL VALUE B1 | ~ | PRINT TIME INITIAL VALUE F1 |
| | 2 | PRINT TIME INITIAL VALUE A2 | PRINT TIME INITIAL VALUE B2 | ~ | PRINT TIME INITIAL VALUE F2 |
| | 3 | PRINT TIME INITIAL VALUE A3 | PRINT TIME INITIAL VALUE B3 | ~ | PRINT TIME INITIAL VALUE F3 |
| | 4 | PRINT TIME INITIAL VALUE A4 | PRINT TIME INITIAL VALUE B4 | ~ | PRINT TIME INITIAL VALUE F4 |
| | ~ | ~ | ~ | ~ | ~ |
| | 15 | PRINT TIME INITIAL VALUE AF | PRINT TIME INITIAL VALUE BF | ~ | PRINT TIME INITIAL VALUE FF |

FIG.27

| PRINT TIME GROUP NO. | PRINT TIME COUNT (SEC.) |
|---|---|
| 0 | 3 |
| 1 | 6 |
| 2 | 9 |
| ~ | ~ |
| 15 | 125 |

IF PRINT TIME COUNT $\leqq$ 3 SEC., PRINT TIME GROUP NO. = 0

FIG.28

| PRINT TIME GROUP NO. | CORRECTION INFORMATION |
|---|---|
| 0 | CORRECTION A |
| 1 | CORRECTION B |
| 2 | CORRECTION C |
| ~ | ~ |
| 15 | CORRECTION F |

IMAGE FORMING APPARATUS

BACKGROUND OF THE INVENTION

1. Technical Field of the Invention

The present invention relates generally to an image-forming apparatus designed to form multi-colored images on a print sheet without any color shifts.

2. Background Art

Full color printers are known which are designed to form a multi-colored image by overlaying yellow, magenta, cyan, and block toner images in registration to a print sheet on a conveyer using a plurality of image-forming units placed in the direction of transport of the print sheet. In a printer of this type, misregistation between toner images will cause outlines off the toner images to be shifted from each other, resulting in reduction in image quality. In order to compensate for this shift, the printer prints the toner images on a conveyer belt and adjusts the interval between adjacent two of the image-forming units based on the images on the conveyer belt. It is, however, difficult to eliminate the shift between the toner images completely due to rises in temperature within the printer, of the conveyer belt itself, and of a belt drive shaft. Particularly, a fixing device usually generates a large quantity of heat, impinging upon the movement of the conveyer belt. Specifically, a print operation for a long time will cause the heat to be stored in a frame installed near the fixing device, thereby resulting in radiation of the heat to elevate the temperature of the conveyer belt and the belt drive shaft. When the print operation is turned off, the fixing device is placed in a standby mode so that the temperature thereof will be decreased. The on and off operations of the printer, thus, causes the temperature of the conveyer belt to be changed, which leads to a change in movement of the conveyer belt. The correction of a shift between toner images due to these thermal problems results in consumption of time in each print operation which will lead to a decrease in throughput.

SUMMARY OF THE INVENTION

It is therefore a principal object of the present invention to avoid the disadvantages of the prior art.

It is another object of the present invention to provide an image-forming apparatus designed to correct a belt speed for forming a multi-color image without any color shift and decrease in throughput.

According to one aspect of the invention, there is provided an image-forming apparatus which comprises: (a) a conveyer belt transporting a print sheet; (b) image-transferring units provided one for each of a plurality of primary colors, the image-transferring units being arrayed in a direction of transport of the print sheet to transfer primary-colored images to the print sheet on the conveyer belt, respectively; (c) a timer measuring an operating time of the apparatus; and (d) a control means for controlling positions where the images are formed by the image-transferring units on the print sheet conveyed by the conveyer belt based on the time measured by the timer.

According to the second aspect of the invention, there is provided an image-forming apparatus which comprises: (a) a conveyer belt transporting a print sheet; (b) image-transferring units provided one for each of a plurality of primary colors, the image-transferring units being arrayed in a direction of transport of the print sheet to transfer primary-colored images to the print sheet on the conveyer belt, respectively; (c) a timer measuring either or any more than two of an elapsed time from turning on of power or release of a sleep mode, a print-off time, and a print time; and (d) a control means for controlling a belt speed based on either or any more than two of the times measured by the timer.

According to the third aspect of the invention, there is provided an image-forming apparatus which comprises: (a) a conveyer belt transporting a print sheet; (b) image-transferring units provided one for each of a plurality of primary colors, the image-transferring units being arrayed in a direction of transport of the print sheet to transfer primary-colored images to the print sheet on the conveyer belt, respectively; (c) a timer measuring either or any more than two of an elapsed time from turning on of power or release of a sleep mode, a print-off time, and a print time; and (d) a control means for controlling an image-transferring cycle of each of the image-transferring units based on either or any more than two of the times measured by the timer.

In a tandem printer structure, the number of lines between the image-forming units (i.e., an interval between the image-forming units expressed in number of lines which can be drawn therebetween) is equal to a passage time between the image-transferring units/an image-transferring cycle (a time lag when each color image starts to be printed). The passage time between the image-transferring units is equal to an image-transferring unit-to-image-transferring unit interval/a belt speed. When a color shift is occurring, an apparent number of lines between the image-forming units is changed. Thus, the color shift may be corrected by changing any of the above terms.

According to the fourth aspect of the invention, there is provided an image-forming apparatus which comprises: (a) a conveyer belt transporting a print sheet; (b) image-transferring units provided one for each of a plurality of primary colors, the image-transferring units being arrayed in a direction of transport of the print sheet to transfer primary-colored images to the print sheet on the conveyer belt, respectively; (c) a timer measuring either or any more than two of an elapsed time from turning on of power or release of a sleep mode, a print-off time, and a print time; and (d) a control means for controlling intervals between the image-transferring units based on either or any more than two of the times measured by the timer.

According to the fifth aspect of the invention, there is provided an image-forming apparatus which comprises: (a) a conveyer belt transporting a print sheet; (b) image-transferring units provided one for each of a plurality of primary colors, the image-transferring units being arrayed in a direction of transport of the print sheet to transfer primary-colored images to the print sheet on the conveyer belt, respectively; (c) a timer measuring either or any more than two of an elapsed time from turning on of power or release of a sleep mode, a print-off time, and a print time; and (d) a control means for controlling an image transfer start timing of each of the image-transferring units based on either or any more than two of the times measured by the timer.

In the preferred mode of the invention, when a temperature of a fixing device is lower than a set temperature, the elapsed time from turning on of power or release of the sleep mode is set to zero (0), the print-off time is set to infinity, the previous print time is set to zero (0), and control of the controlling means is performed. The controlling means may also drive the conveyer belt for a constant period of time prior to a color shift detecting operation. The driving of the conveyer belt may be performed intermittently.

When the temperature of a fixing device is lower than the set temperature, a color shift detecting operation may be performed as is.

The timer has a clock circuit supported at least by a backup battery or a structure reading therein information on an external time. Based on this structure, after the power is turned on or the release of the sleep mode, the controlling means calculates the print-off time in a power-off condition from a final printing end time stored in a nonvolatile memory and performs each control.

According to the sixth aspect of the invention, there is provided an image-forming apparatus which comprises: (a) a conveyer belt transporting a print sheet; (b) image-transferring units provided one for each of a plurality of primary colors, the image-transferring units being arrayed in a direction of transport of the print sheet to transfer primary-colored images to the print sheet on the conveyer belt, respectively; (c) a timer measuring at least a print-off time and a print time; (d) a storage means for storing therein a first belt speed change curve for obtaining a belt speed estimated as a function of the print time and a second belt speed change curve for obtaining a belt speed estimated as a function of the print-off time when a print operation is started again after a lapse of the print-off time; and (e) a controlling means determining a belt speed corresponding to the previous print time from the first belt speed change curve based on the print-off time and the print time measured by the timer, sets a point on the second belt speed change curve matching the determined belt speed to a count start point of the print-off time to further determine a belt speed on the second belt speed change curve after a lapse of the print-off time, and considers the determined belt speed as one after a lapse of a print time corresponding to the belt speed on the first belt speed change curve in the current print operation to control the belt speed.

In the preferred mode of the invention, the storage means has a table defining first belt speed correction values and second belt speed correction values corresponding to the first belt speed change curve and the second belt speed change curve. The controlling means determines the first belt speed correction value from the table which corresponds to the previous print time, determines a point on which the second belt speed correction value matching the first belt speed correction value is located as the count start point to further determine the second belt speed correction value on the table after a lapse of the print-off time, and considers the determined second belt speed correction value as one after a lapse of a print time corresponding to the first belt speed correction value on the table in the current print operation to perform control from that time.

According to the seventh aspect of the invention, there is provided an image-forming apparatus which comprises: (a) a conveyer belt transporting a print sheet; (b) image-transferring units provided one for each of a plurality of primary colors, the image-transferring units being arrayed in a direction of transport of the print sheet to transfer primary-colored images to the print sheet on the conveyer belt, respectively; (c) a timer measuring at least a print-off time and a print time; (d) a storage means for storing therein a first belt speed change curve for obtaining a belt speed estimated as a function of the print time and a second belt speed change curve for obtaining a belt speed estimated as a function of the print-off time when a print operation is started again after a lapse of the print-off time; and (e) a controlling means determining a belt speed corresponding to the previous print time from the first belt speed change curve based on the print-off time and the print time measured by the timer, sets a point on the second belt speed change curve matching the determined belt speed to a count start point of the print-off time to further determine a belt speed on the second belt speed change curve after a lapse of the print-off time, and considers the determined belt speed as one after a lapse of a print time corresponding to the belt speed on the first belt speed change curve in the current print operation to control an image-transferring cycle of each of the image-transferring units.

In the preferred mode of the invention, the storage means has a table defining first image-transferring cycle correction values and second image-transferring cycle correction values corresponding to the first belt speed change curve and the second belt speed change curve. The controlling means determines the first image-transferring correction value from the table which corresponds to the previous print time, determines a point on which the second image-transferring correction value matching the first image-transferring correction value is located as the count start point to further determine the second image-transferring correction value on the table after a lapse of the print-off time, and considers the determined second image-transferring correction value as one after a lapse of a print time corresponding to the first image-transferring correction value on the table in the current print operation to perform control from that time.

According to the eighth aspect of the invention, there is provided an image-forming apparatus which comprises: (a) a conveyer belt transporting a print sheet; (b) image-transferring units provided one for each of a plurality of primary colors, the image-transferring units being arrayed in a direction of transport of the print sheet to transfer primary-colored images to the print sheet on the conveyer belt, respectively; (c) a timer measuring at least a print-off time and a print time; (d) a storage means for storing therein a first belt speed change curve for obtaining a belt speed estimated as a function of the print time and a second belt speed change curve for obtaining a belt speed estimated as a function of the print-off time when a print operation is started again after a lapse of the print-off time; and (e) a controlling means determining a belt speed corresponding to the previous print time from the first belt speed change curve based on the print-off time and the print time measured by the timer, sets a point on the second belt speed change curve matching the determined belt speed to a count start point of the print-off time to further determine a belt speed on the second belt speed change curve after a lapse of the print-off time, and considers the determined belt speed as one after a lapse of a print time corresponding to the belt speed on the first belt speed change curve in the current print operation to control intervals between the image-transferring units.

In the preferred mode of the invention, the storage means has a table defining first image-transferring unit-to-image-transferring unit interval correction values and second image-transferring unit-to-image-transferring unit interval correction values corresponding to the first belt speed change curve and the second belt speed change curve. The controlling means determines the first image-transferring unit-to-image-transferring unit interval correction value from the table which corresponds to the previous print time, determines a point on which the second image-transferring unit-to-image-transferring unit correction value matching the first image-transferring unit-to-image-transferring unit correction value is located as the count start point to further determine the second image-transferring unit-to-image-transferring unit correction value on the table after a lapse of the print-off time, and considers the determined second image-transferring unit-to-image-transferring unit correction value as one after a lapse of a print time corresponding to the first image-transferring unit-to-image-transferring unit correction value on the table in the current print operation to perform control from that time.

According to the ninth aspect of the invention, there is provided an image-forming apparatus which comprises: (a) a conveyer belt transporting a print sheet; (b) image-transferring units provided one for each of a plurality of primary colors, the image-transferring units being arrayed in a direction of transport of the print sheet to transfer primary-colored images to the print sheet on the conveyer belt, respectively; (c) a timer measuring at least a print-off time and a print time; (d) a storage means for storing therein a first belt speed change curve for obtaining a belt speed estimated as a function of the print time and a second belt speed change curve for obtaining a belt speed estimated as a function of the print-off time when a print operation is started again after a lapse of the print-off time; and (e) a controlling means determining a belt speed corresponding to the previous print time from the first belt speed change curve based on the print-off time and the print time measured by the timer, sets a point on the second belt speed change curve matching the determined belt speed to a count start point of the print-off time to further determine a belt speed on the second belt speed change curve after a lapse of the print-off time, and considers the determined belt speed as one after a lapse of a print time corresponding to the belt speed on the first belt speed change curve in the current print operation to control an image-transferring start timing of each of the image-transferring unit.

In the preferred mode of the invention, the storage means has a table defining first image-transferring start timing correction values and second image-transferring start timing correction values corresponding to the first belt speed change curve and the second belt speed change curve. The controlling means determines the first image-transferring start timing correction value from the table which corresponds to the previous print time, determines a point on which the second image-transferring start timing correction value matching the first image-transferring start timing correction value is located as the count start point to further determine the second image-transferring start timing correction value on the table after a lapse of the print-off time, and considers the determined second image-transferring start timing correction value as one after a lapse of a print time corresponding to the first image-transferring start timing correction value on the table in the current print operation to perform control from that time.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 22 is Table 1 showing speed correction values corresponding to elapsed time from start of belt movement.

FIG. 23 is Table 2 showing elapsed time from start of belt movement corresponding to print-off time.

FIG. 24 is Table 3 showing first belt speed correction values corresponding to print time and print-off time.

FIG. 25 is Table 4 showing print-off time counts corresponding to print-off time group numbers.

FIG. 26 is Table 5 showing print time initial values corresponding to print time group numbers and print-off time group numbers.

FIG. 27 is Table 6 showing print time counts corresponding to print time group numbers.

FIG. 28 is Table 7 showing correction information corresponding to print time group number.

DESCRIPTION OF THE PREFERRED EMBODIMENTS

Figure 1:
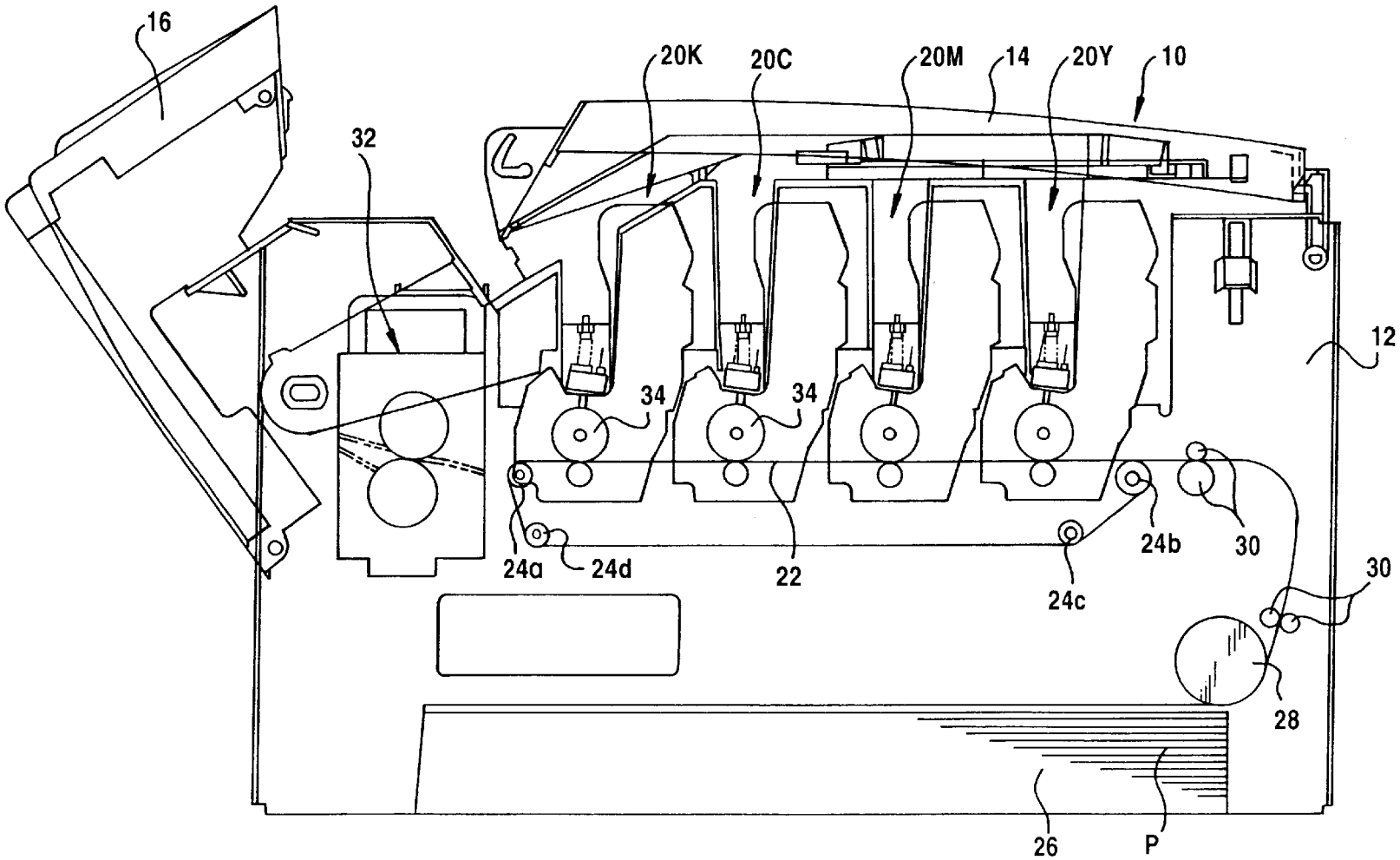
FIG. 1 is a cross sectional view which shows an image-forming device according to the invention.

Referring now to the drawings, wherein like numbers refer to like parts in several views, particularly to FIG. 1, there is shown an image-forming device 10 according to the invention which will be discussed below as a full color printer.

The image-forming device 10 has four print assemblies 20Y, 20M, 20C, and 20K arranged in line and an endless conveyer belt 22 traveling through the print assemblies 20Y to 20K. The conveyer belt 22 is made of a synthetic resin material such as fluorine-contained polymers (e.g., Polyvinylidene Fluoriden) which has high durability and ability to hold a print sheet P statically. The conveyer belt 22 is wound around four rollers 24*a*, 24*b*, 24*c*, and 24*d*. The roller 24*a* is a drive roller which also works as an AC discharge roller to remove a charge from the conveyer belt 22. The roller 24*b* is a driven roller and also works as an electrifying roller to electrifies the conveyer belt 22. The rollers 24*c* and 24*d* are guide rollers. The roller 24*d* also works as a tension roller which provides a given degree of tension to the conveyer belt 22.

A hopper 26 is disposed beneath the conveyer belt 22 which stores therein a stack of print sheets P. A pickup roller 28 picks up one of the print sheets P from the hopper 26 and carries it to the conveyer belt 22 through a pair of paper feed rollers 30. The print sheet P is transported by the conveyer belt 22 to the print assemblies 20Y, 20M, 20C, and 20K in which full color images are printed, fed to a fixing device 32, and ejected through a guide roller (not shown) installed on an end cover 16 toward a stacker provided on an upper surface of a top cover 14.

The conveyer belt 22 is charged by the driven roller 24*b* to hold thereon the print sheet P when it reaches the conveyer belt 22 through the driven roller 24*b*. The print sheet is, thus, moved to a printing station in a given positional relation to the conveyer belt 22. The drive roller 24*a*, as described above, works as the discharge roller which removes charges from the conveyer belt 22, thereby causing the print sheet P to be separated from the conveyer belt 22 when it reaches the drive roller 24*a*. The print sheet P is next carried to the fixing device 32.

The print assemblies 20Y, 20M, 20C, and 20K are identical in structure. The primary distinction between them is the color of toner particles contained therein. Specifically, the print assembly 20Y stores therein developer containing yellow toner particles to form a yellow toner image on the print sheet P on the conveyer belt 22. The print assembly 20M stores therein developer containing magenta toner particles to form a magenta toner image on the print sheet P on the conveyer belt 22. The print assembly 20C stores therein developer containing cyan toner particles to form a cyan toner image on the print sheet P on the conveyer belt 22.

When the print sheet P enters the print station at the driven roller 24*b* and passes through the print assemblies 20Y, 20M, 20C, and 20K, yellow, magenta, cyan, and black toner images are overlaid to form a full color image on the print sheet P. The print sheet P is next transported from the drive roller 24*a* to the heat roller type fixing device 32 in which the full color image is thermally fixed on the print sheet P.

Figure 2:
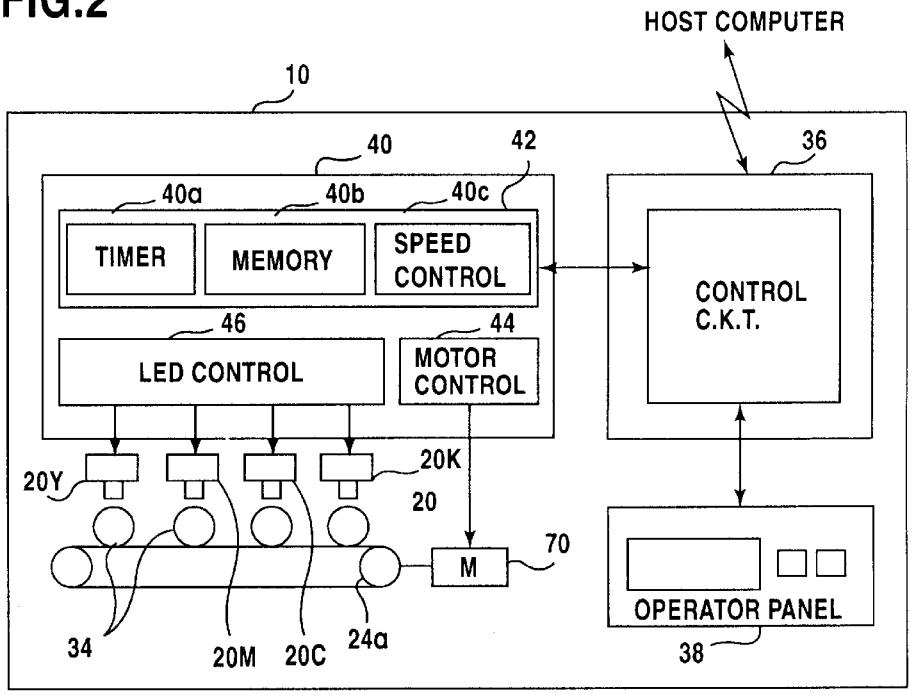
FIG. 2 is a block diagram which shows a circuit structure of an image-forming apparatus.

Each of the print assemblies 20Y, 20M, 20C, and 20K is designed as an image transferring unit 20, as shown in FIG. 2, which includes a photosensitive drum 34, a charging roller (not shown), a developing device (not shown), and a toner cleaner (not shown). Each image-forming unit 20 is installed detachably on a frame 12.

Prior to describing an operation of the image-forming device 10, how it was developed will be discussed in detail below.

The conventional tandem color printers wherein a print sheet is transported by a conveyer belt to a print station in which a plurality of image transfer units are placed in line have problems in that a belt drive shaft is heated by radiation of heat from a fixing device located near the belt drive shaft, leading to a local rise in temperature of the conveyer belt, and the conveyer belt is cooled as moving away from the belt drive shaft, which results in a considerable change in temperature of the conveyer belt, thereby causing the speed of the conveyer belt to be changed. The change in speed of the conveyer belt will cause the timing where each of Y, M, C, and K toner images is transferred to the print sheet to be shifted from the timing where the print sheet passes a corresponding one of the image transfer units, thereby resulting in a shift between colors.

Specifically, the main factor of the change in speed of the conveyer belt is thermal expansion of the conveyer belt caused by transfer of the heat from the belt drive shaft. The greater a difference in temperature between the conveyer belt and the belt drive shaft, the higher will be the speed of the thermal expansion of the conveyer belt. As the difference in temperature reaches zero, the speed of the thermal expansion becomes low. Specifically, the thermal expansion of the conveyer belt occurs at an exponential rate.

Upon turning off of the printer, the conveyer belt is cooled by surrounding air so that the temperature thereof is decreased at an exponential rate until a difference in temperature between the conveyer belt and the surrounding air reaches zero. The temperature of the conveyer belt at the start of a print operation, thus, depends upon the temperature of the conveyer belt at the end of a previous print operation and the elapsed time between the end of the print operation and resumption thereof (which will also referred to as a belt rest time or print-off time below).

As will be apparent from the above discussion, the speed of the conveyer belt depends upon the temperatures within the printer and of the conveyer belt and the belt drive shaft each of which is determined as a function of the time interval between the end of the print operation and resumption thereof plus the elapsed time from the resumption. A change in speed of the conveyer belt will result in a shift between colors of toner images on the print sheet.

The image-forming device 10 also includes, as shown in FIG. 2, a controller 36 and a print engine controller 40. The controller 36 has an operator panel 38 and communicates with a host computer to separate a color image to be printed into primary color images (i.e., toner images) and to control the whole operation of the image-forming device 10. The print engine controller 40 controls mechanisms of the image-forming device 10 and includes a main control circuit 42, an LED control circuit, and a motor control circuit 44. The main control circuit 42 consists of a timer 40*a*, a memory 40*b*, and a speed control circuit 40*c*. The timer 40*a* measures the elapsed time from turning on of the image-forming device 10 or from release of a sleep mode of operation, the print off-time that is the time interval between the end of the print operation and resumption thereof, and the printing time. The memory 40*b* stores correction tables listing first belt speed correction values and second belt speed correction values, as will be described in detail later. The speed control circuit 40*c* controls the speed of the conveyer belt 22 as a function of the times measured by the timer 40*a*.

The timer 40*a* is made up of a clock generator (not shown) having a crystal oscillator and a counter (not shown) counting the number of clocks generated by the clock generator.

The memory 40*b* is made of a ROM or an EPROM and may alternatively be a memory card for facilitating ease of rewriting of the correction tables stored therein.

The speed control circuit 40*c* is made of a central processing unit which receives a signal indicative of the time measured by the timer 40*a* and looks up the table in the memory 40*b* to output a control signal indicative of a target speed to the motor control circuit 44. The motor control circuit 44 controls the electric motor 70 to bring the speed of the drive roller 24*a* of the conveyer belt 22 into agreement with the target speed.

The LED control circuit 46 controls an LED head installed in each of the image transfer units 20.

The speed control circuit 40*c* controls the speed of the conveyer belt 22 in two modes of operation: a belt idle mode and a belt speed correction mode as will be described below in detail.

In an initial mode of printer operation following turning on of the image-forming device 10, before the top cover 14 is closed, or in a sleep mode of printer operation, it is impossible for the timer 40*a* to determine the print off-time, so that the belt speed correction mode, as will be described later in detail, cannot be entered even after the top cover 14 is closed or the sleep mode is released. Therefore, when the temperature of the fixing device 32 is higher than a set value (e.g., 80° C.), the speed control circuit 40*c* idles the conveyer belt 22 for a given period of time (e.g., at the same speed as that in a monochrome print mode for 60 sec.) to stabilize the speed of the conveyer belt 22 prior to a typical color shift detecting operation in which toner images are printed on the conveyer belt 22 to detect a shift between colors which is to be corrected when toner images are transferred in registration to the print sheet P. This is because when the fixing device 32 is warmed, it seems that the temperature of a drive shaft of the conveyer belt 22 and the drive roller 24*a* is elevated, so that the speed of the conveyer belt 22 is slower than a saturated speed. Alternatively, when the temperature of the fixing device 32 is lower than the set value, the speed control circuit 40*c* does not idle the conveyer belt 22.

Figure 3:
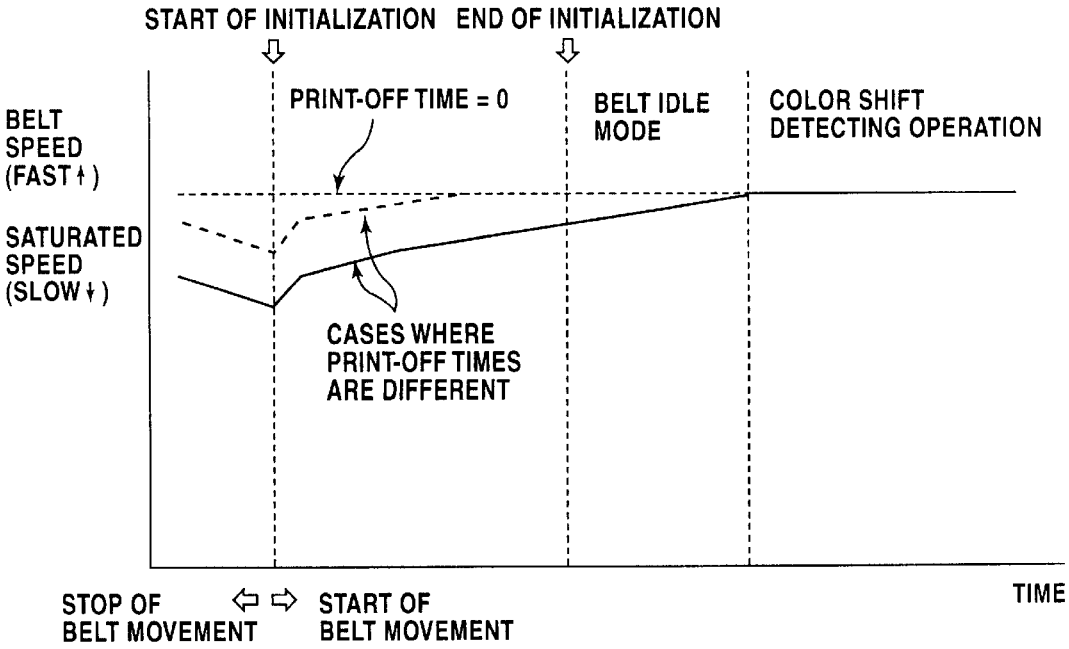
FIG. 3 is a graph which shows a change in speed of a conveyer belt when idled prior to a color shift detecting operation following initialization.

FIG. 3 shows a change in speed of the conveyer belt 22 during the belt idle mode following initialization, as will be described later in detail, prior to the color shift detecting operation. At the start of the initialization, the speed of the conveyer belt 22, as indicated by broken and solid lines, depends upon the print off-time after the last print operation and the history of print on and off operations before the last print operation, but it becomes stable after the conveyer belt 22, i.e., the drive roller 24*a* is idled for the given period of time required for the conveyer belt 22 to be saturated in speed after the print off-time reaches infinity.

Additionally, it is also impossible for the speed control circuit 40*c* to enter the belt speed correction mode when the print engine controller 40 is turned off to stop controlling the mechanisms in the print standby mode, as will be described later in detail, so that the timer 40*a* is deactivated. Therefore, when the temperature of the fixing device 32 is higher than the set value (e.g., 80° C.), the speed control circuit 40*c* enters the belt idle mode to idle the conveyer belt 22 for the given period of time to stabilize the speed of the conveyer belt 22 prior to the color shift detecting operation. Alternatively, when the temperature of the fixing device 32 is lower than the set value, the color shift detecting operation is performed without idling the conveyer belt 22. Afterwards, when the timer 40*a* becomes activated, the print-off time and the print time measured and held in the timer 40*a* are reset, and the print operation is started.

When the timer 40*a* starts in the print standby mode, the speed control circuit 40*c* enters the belt speed correction mode to correct the speed of the conveyer belt 22, as will be discussed below in detail.

Figure 4:
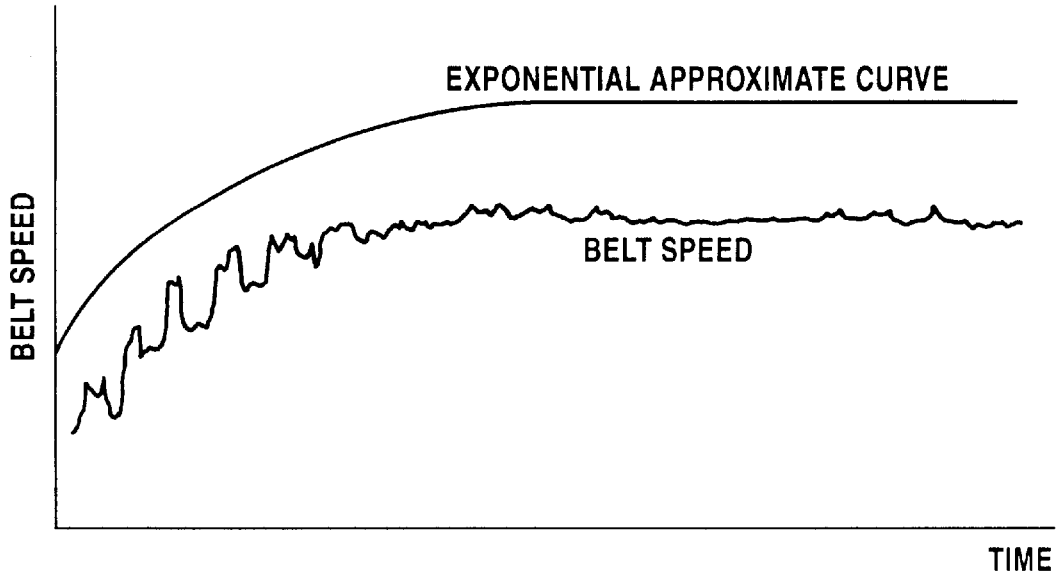
FIG. 4 is a graph which shows a change in speed of a conveyer belt when a print operation is started from a standby mode.
Figure 5:
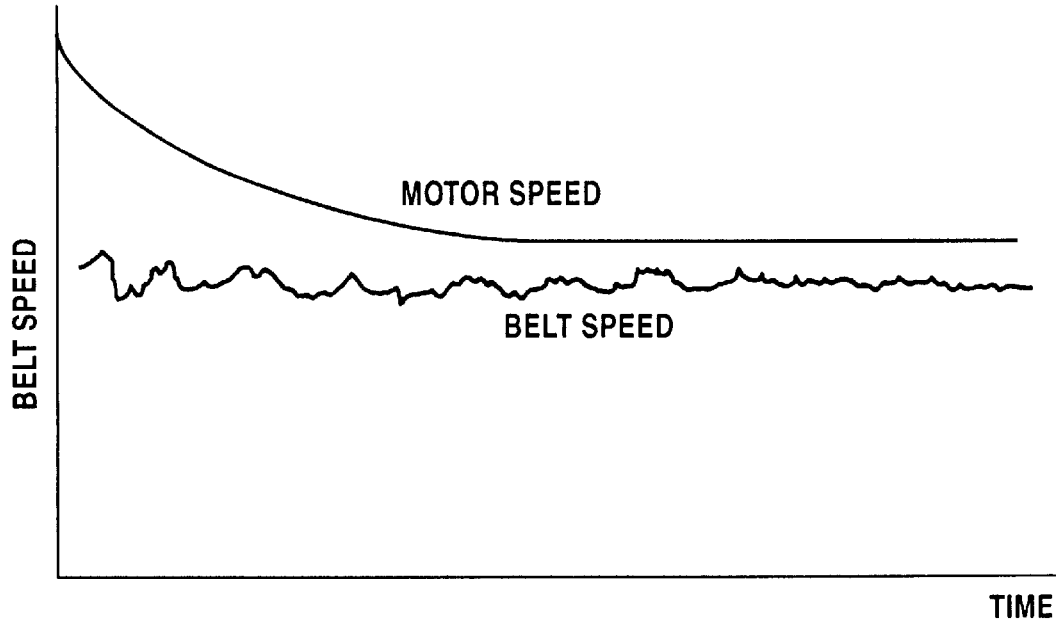
FIG. 5 is a graph which shows a change in speed of a conveyer belt when corrected.

Usually, upon start of the print operation following the print standby mode, the speed of the conveyer belt 22 is changed, as shown in FIG. 4, as a function of changes in temperature of the drive shaft of the conveyer belt 22, the drive roller 24*a*, and the conveyer belt 22. An exponential approximate curve which is approximate to the change in speed of the conveyer belt 22 is defined and used to make a correction table listing speed correction values for correcting the speed of the drive roller 24*a* (i.e., the speed of the motor 70). The correction table is stored in the memory 40*b*. The speed control circuit 40*c* reads the print time (i.e., the elapsed time from the start of the print operation) out of the timer 40*a* to correct the speed of the conveyer belt 22 by look-up using the correction table in the memory 40*b* and keeps it, as shown in FIG. 5, constant.

The initial speed of the conveyer belt 22 at the start of the belt speed correction mode, in fact, depends upon the print off-time after the last print operation is completed, the print time in the last print operation, and the history of print on and off operations before the last print operation. Particularly, in a case where the print operation is resumed within a short period of time following termination of the last print operation before the speed of the conveyer belt 22 becomes stable, the speed of the conveyer belt 22 upon resumption of the print operation is almost equal to that upon termination of the last print operation. The longer the length of time the print operation is paused, the greater will be a change in speed of the conveyer belt 22 upon resumption of the print operation. A plurality of correction tables, thus, need to be prepared as a function of the length of time the print operation is paused, but it results in a greatly consumed storage area of the memory 40*b*. In order to alleviate this problem, the image-forming device 10 of this embodiment uses correction tables one in each print mode regardless of the print-off time and changes, as discussed below in detail, an initial value to be read out of each of the correction tables in view of history of print on and off operations.

In the following discussion, it is premised that changes in speed of the conveyer belt 22 when the conveyer belt 22 is at rest and moving are approximate to exponential curves, respectively.

The first belt speed curve f1(t) used to estimate the speed of the conveyer belt 22 as a function of the print time and the second belt speed curve f2(t) used to estimate the speed of the conveyer belt 22 upon resumption of the print operation as a function of the print off-time may be represented as $$f1(t)=v0\cdot\{1-\alpha\cdot\mathrm{Exp}(-t/\tau 0)\} \quad (1)$$

$$f2(t)=v0\cdot\{1-\alpha+\alpha\cdot\mathrm{Exp}(-t/\tau 1)\} \quad (2)$$

where v0 is the saturated speed, $\alpha$ is a maximum value of a change in speed, $\tau 0$ is a time constant indicating a rate of change in temperature of the drive roller 24*a* during the print operation, and $\tau 1$ is a time constant indicating a rate of change in temperature of the drive roller 24*a* during the standby mode of print operation.

Figure 6:
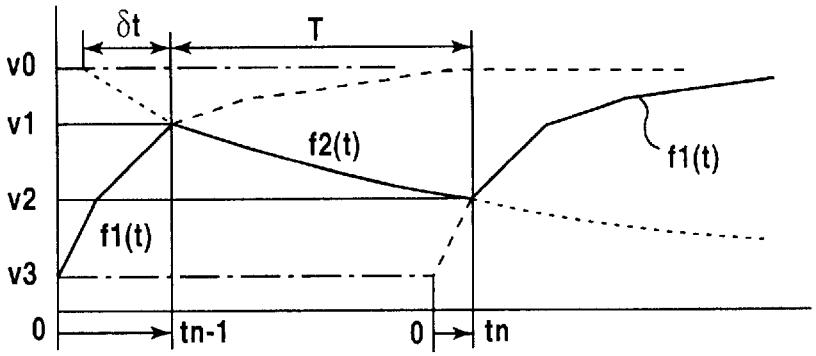
FIG. 6 is a graph which shows a change in speed of a conveyer belt when a print operation is terminated before the speed of the conveyer belt becomes stable, and a subsequent print operation is started.

In a case where the print operation is resumed the print off-time T after the last print operation is terminated before the speed of the conveyer belt 22 becomes stable, changes in speed of the conveyer belt 22 may be, as shown in FIG. 6, expressed using the first and second belt speed curves f1(t) and f2(t).

In FIG. 6, the following relations are met at the end of the last print operation and at the start of the current print operation.

$$v1=f1(tn-1)=f2(\delta t)$$

$$v0\cdot\{1-\alpha\cdot\mathrm{Exp}(-tn-1/\tau 0)\}=v0\cdot\{1-\alpha+\alpha\cdot\mathrm{Exp}(-\delta t/\tau 1)\} \quad (3)$$

$$v2=f1(tn)=f2(\delta t+T)$$

$$v0\cdot\{1-\alpha\cdot\mathrm{Exp}(-tn/\tau 0)\}=v0\cdot\{1-\alpha+\alpha\cdot\mathrm{Exp}(-\delta t+T/\tau 1)\} \quad (4)$$

where v1 is the speed upon termination of the last print operation, v2 is the speed upon start of the current print operation, tn is the first value (sec.) to be read out of the correction table at the start of the current print operation (i.e., the elapsed time from the start of the print operation), tn−1 is the last value (sec.) read out of the correction table at the end of the last print operation (i.e., the elapsed time between the start and end of the print operation), and T is the print off-time from the end of the last print operation.

From the equations (3) and (4), the relation between the first value tn to be read out of the correction table at the start of the current print operation and the last value tn−1 read out of the correction table at the end of the last print operation is $$tn=-\tau 0\cdot\ln\{1-\mathrm{Exp}(-T/\tau 1)\cdot[1-\mathrm{Exp}(-tn-1/\tau 0)]\}$$

When the temperature of the fixing device 32 is lower than the set value (e.g., 80° C.), it hardly changes, as described above, the temperature of the drive shaft of the conveyer belt 22 and the drive roller 24*a*. Therefore, in this case, the speed control circuit 40*c* sets the elapsed time from turning on of the image-forming device 10, closing of the top cover 14, or release of the sleep mode to zero (0), the print-off time to infinity, and the print time in the last print operation to zero (0) and controls the speed of the conveyer belt 22 in the above described manner.

Figure 7:
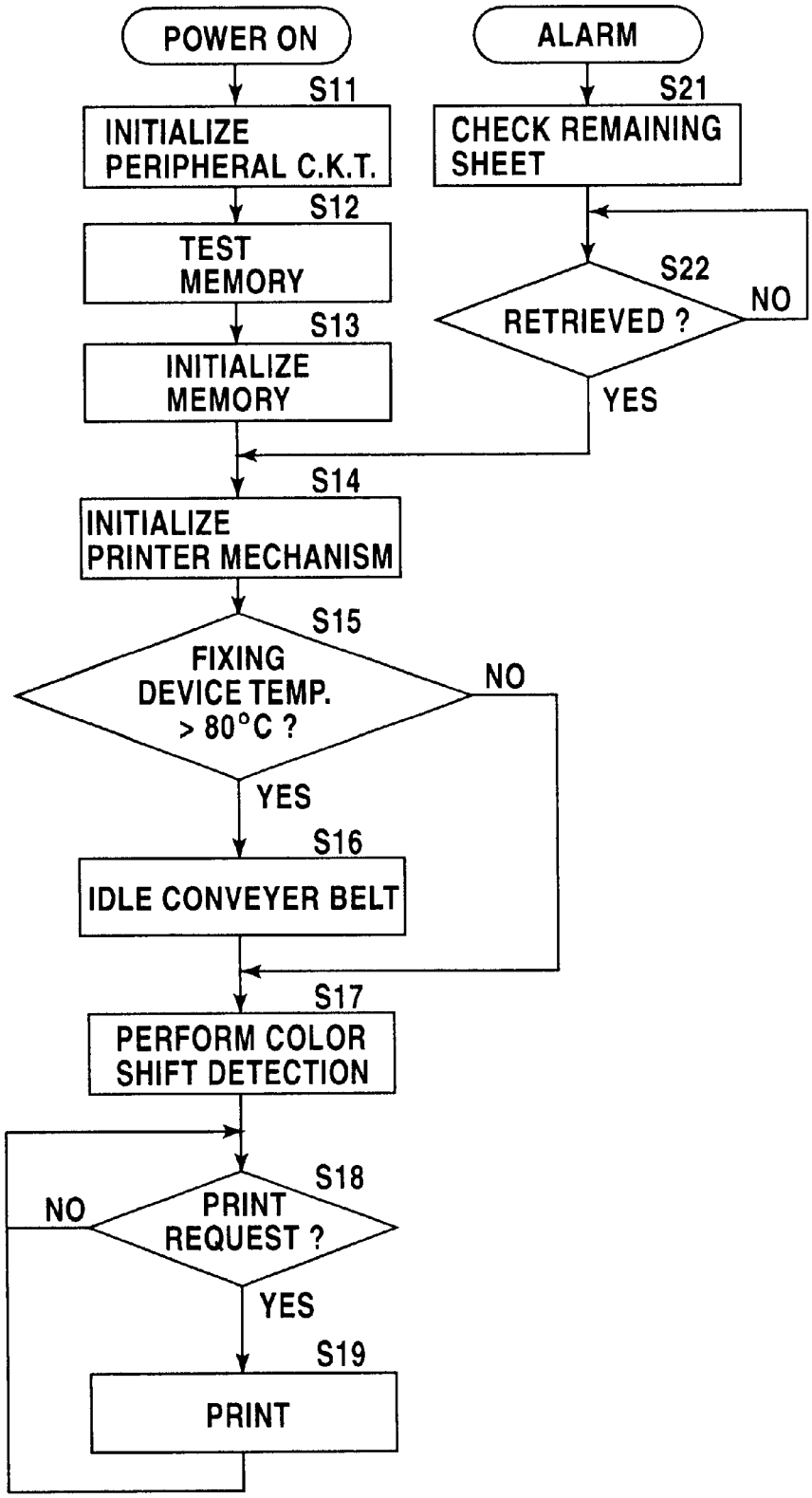
FIG. 7 is a flowchart of a program performed after power supply until a print operation is performed.

FIG. 7 shows a flowchart of a program or sequence of logical steps performed by the image-forming device 10 after turned on.

After entering the program, the routine proceeds to step S11 wherein peripheral circuits, i.e., the LED control circuit 46 and the motor control circuit 44 are initialized. The routine proceeds to step S12 wherein a memory test is performed to test the memory 42*b*, a control program storage ROM (not shown), and a RAM installed in the print engine controller 40. The routine proceeds to step S13 wherein parameters indicating the print-off time and the print time stored in the memory 42*b* and parameters indicating a paper feed outlet and a print mode (a color or monochrome mode) stored in the RAM are reset. The routine proceeds to step S14 wherein the printer mechanisms are initialized to check the presence of the image-transferring units 20, the remaining amount of toner, a paper jam, etc.

The routine proceeds to step S15 wherein it is determined whether the temperature of the fixing device 32 is higher than 80° C. or not. If a YES answer is obtained, then the routine proceeds to step S16 wherein the conveyer belt 22 is idled at the same speed as that in the monochrome print mode for 60 sec. in the belt idle mode. Alternatively, if a NO answer is obtained, then the routine proceeds directly to step S17 wherein the color shift detecting operation is performed. The routine proceeds to step S18 wherein it is determined whether a print request has been made or not. If a NO answer is obtained, then the routine repeats step S18. Alternatively, if a YES answer is obtained, then the routine proceeds to step S19 wherein the print operation is started.

If an alarm signal is outputted, the routine proceeds to step S21 wherein the presence of a print sheet left in a paper transport path, for example, due to a paper jam occurring in the previous print operation is checked. The routine proceeds to step S22 wherein it is determined whether the print sheet left in the paper transport path has been retrieved or not. If a NO answer is obtained, then the routine repeats step S22. Alternatively, if a YES answer is obtained, then the routine proceeds to step S14.

Figure 8:
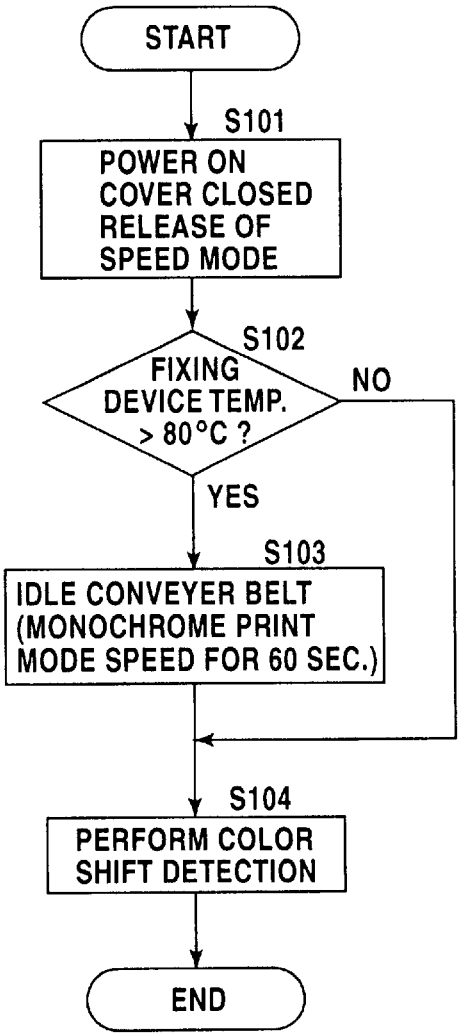
FIG. 8 is a flowchart of a program performed when a conveyer belt is idled until a color shift detecting operation is performed.

FIG. 8 shows a sequence of steps performed in FIG. 7 prior to the color shift detecting operation in brief.

When the cover 14 is closed after the power is turned on, so that the alarm is turned off or when the sleep mode is released (step S101), the speed control circuit 40*c* determines whether the temperature of the fixing device 32 is higher than 80° C. or not (step S102). If the temperature of the fixing device 32 is higher than 80° C., then the speed control circuit 40*c* idles the conveyer belt 22 at the same speed as that in the monochrome mode for 60 sec. (step S103). Alternatively, if the temperature of the fixing device 32 is lower than 80° C., then the color shift detecting operation is performed without idling the conveyer belt 22 (step S104).

Figure 9:
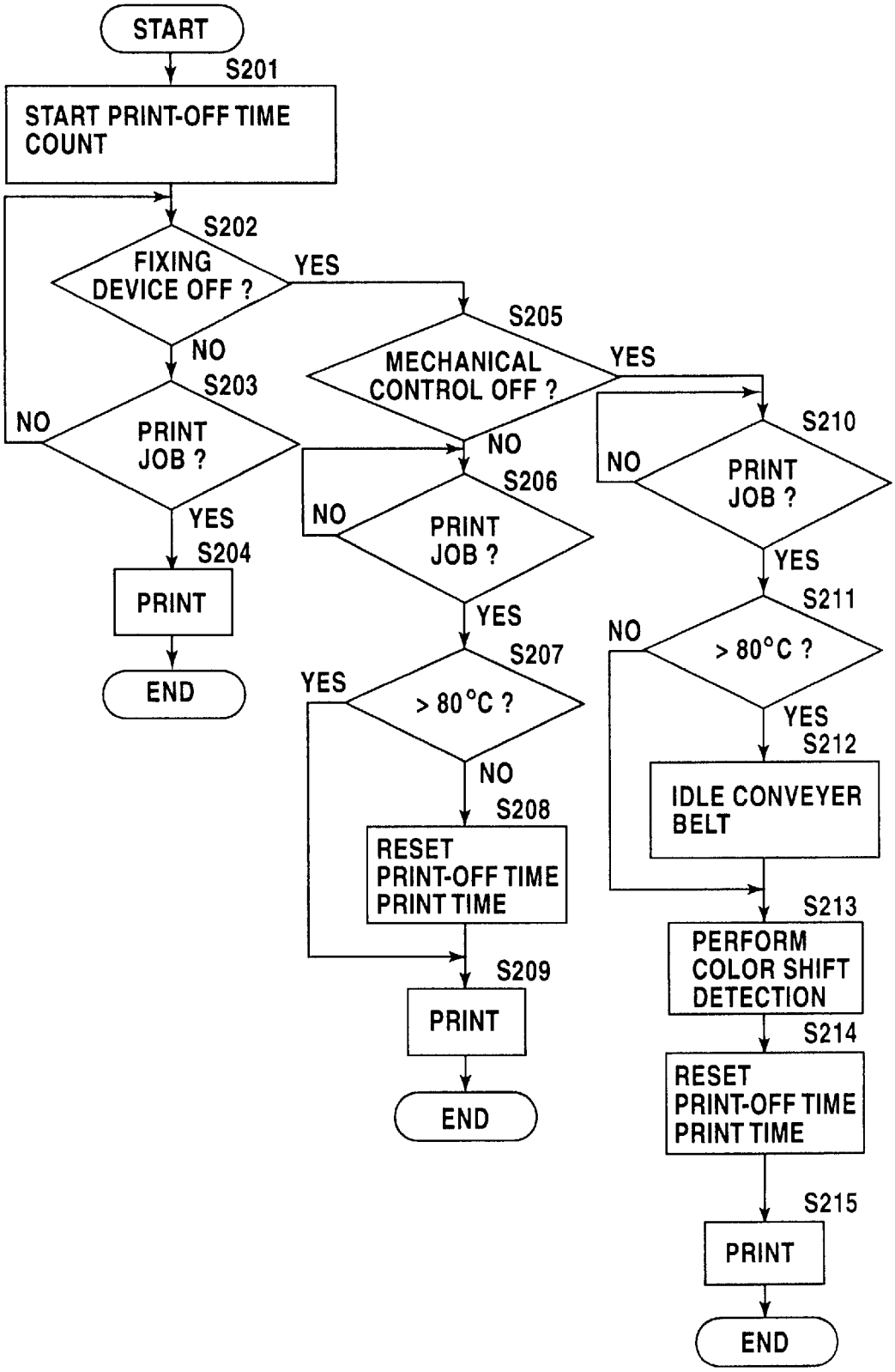
FIG. 9 is a flowchart of a program performed to correct speed of a conveyer belt after a color shift detecting operation when a print operation is started again from a print standby mode.

FIG. 9 shows a flowchart of a subprogram performed in the belt speed correction mode immediately before step S18 following the color shift detecting operation in step S17 or the print operation in step S19 in FIG. 7.

In step S201, the timer 40*a* is activated to measure the print-off time upon termination of the color shift detecting operation or the print operation. The routine proceeds to step S202 wherein it is determined whether the power supplied to the fixing device 32 is turned off or not. If a NO answer is obtained meaning that the power is being supplied to the fixing device 32, then the routine proceeds to step S203 wherein the speed control circuit 40*c* determines whether there is a print job or not. If a YES answer is obtained, then the routine proceeds to step S204 wherein the print operation is started, and the above described belt speed correction is performed. Alternatively, if a NO answer is obtained, then the routine returns back to step S202.

If a YES answer is obtained in step S202 meaning that the power is not supplied to the fixing device 32, then the routine proceeds to step S205 wherein it is determined whether the speed control circuit 40*c* is stopping controlling the printer mechanisms or not. If a NO answer is obtained meaning that the control of the print mechanism is being performed, then the routine proceeds to step S206 wherein there is a print job or not. If a NO answer is obtained, then the routine repeats step S206. Alternatively, if a YES answer is obtained, then the routine proceeds to step S207 wherein it is determined whether the temperature of the fixing device 32 is higher than 80° C. or not. If a NO answer is obtained meaning that the image-forming device 10 is in a cold condition, then the routine proceeds to step S208 wherein the print-off time and the print time stored in the timer 40*a* are reset. Alternatively, if a YES answer is obtained, then the routine proceeds directly to step S209 wherein the print operation is started.

If a YES answer is obtained in step S205 meaning that the speed control circuit 40*c* is stopping controlling the printer mechanisms, then the routine proceeds to step S210 wherein there is a print job or not. If a NO answer is obtained, then the routine repeats step S210. Alternatively, if a YES answer is obtained, then the routine proceeds to step S211 wherein it is determined whether the temperature of the fixing device 32 is higher than 80° C. or not. If a YES answer is obtained, then the routine proceeds to step S212 to perform the conveyer belt 22 is idled in the manner as described above. Alternatively, if a NO answer is obtained meaning that the image-forming device 10 is in a cold condition, then the routine proceeds directly to step S213 wherein the color shift detecting operation is performed. The routine proceeds to step S214 wherein the print-off time and the print time stored in the timer 40*a* are reset. The routine proceeds to step S215 wherein the print operation is started.

If, in the belt speed correction mode, the speed control circuit 40*c* calculates a correction value of the speed of the motor 70 using a table listing a change in speed of the conveyer belt 22, as shown in FIG. 6, stored in the memory 40*b* and then controls the speed of the motor 70 to regulate the speed of the drive roller 24*a*, it will result in a decrease in control speed. In order to avoid this problem, this embodiment prepares, as described above, the correction tables for correcting the speed of the conveyer belt 22 in the memory 40*b*.

A method of making the correction tables will be described below.

First, a method of correcting a color shift will be discussed. A shift in actual speed of the conveyer belt 22 from a nominal speed in design may be expressed as $$\text{speed shift}=-A_0e^{ct}$$

where $-A_0$ is a value, as will be described later in detail, determined based on the length of time the conveyer belt 22 is left as is (i.e., the print-off time) after the print operation or the initialization.

Figure 10:
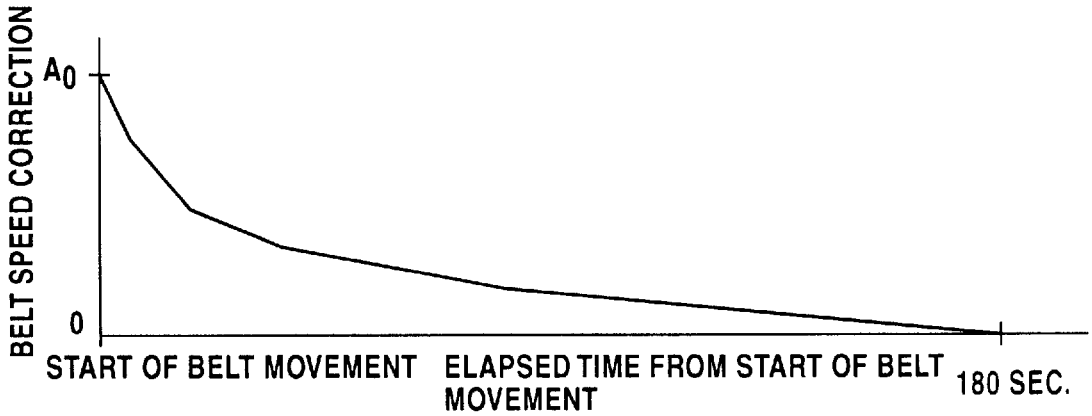
FIG. 10 is a graph which shows a relation between a belt speed correction and a print time.

The correction of the speed shift may be achieved by controlling the speed of the conveyer belt 22, as shown in FIG. 10. Specifically, when the conveyer belt 22 begins to be moved, the speed thereof increases gradually and then stabilizes. Thus, a correction of the speed of the conveyer belt 22, as shown in the drawing, is to made until it reaches a saturated value.

Figure 11:
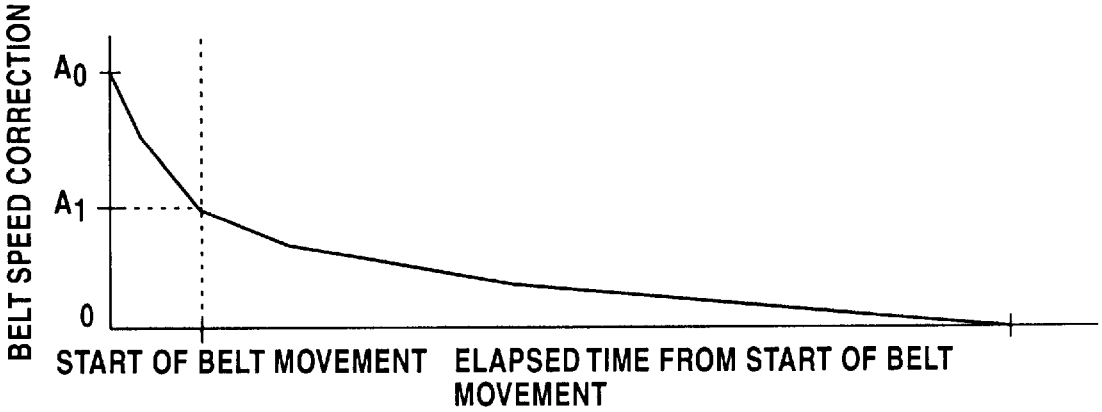
FIG. 11 is a graph which shows a relation between a belt speed correction and a print time when a print-off time is short.

However, if an initial value of the speed shift is smaller than one shown in FIG. 10, that is, if the print-off time is short, the correction control is started using as an initial value a correction value $A_1$ ($A_1<A_0$), as indicated in FIG. 11, which is defined below $A_0$ on the correction curve expressed in an exponential function. A required correction of the speed of the conveyer belt 22 is increased as the print-off time is prolonged, but it is saturated in time. The required correction when saturated is thus defined, as shown in FIGS. 10 and 11, as the upper limit $A_0$.

Figure 12:
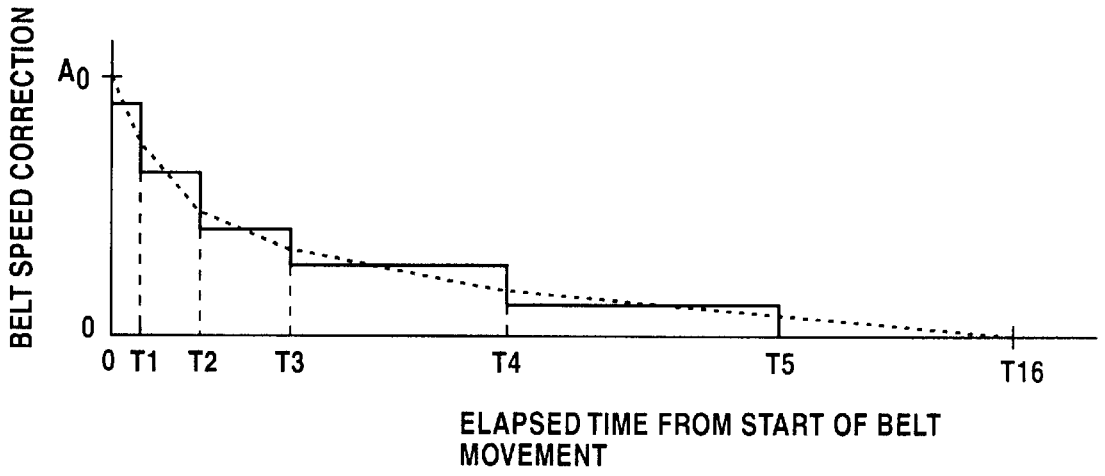
FIG. 12 is a graph which shows how to determine approximate values of belt speed correction values.

It is usually difficult to calculate the above belt speed correction every print operation. Thus, approximate values, as shown in FIG. 12, are calculated and listed in table 1. The table 1 (FIG. 22) is stored in the memory 40*b* and looked up at regular intervals of one sec. In practice, the table 1 is prepared for each of different controlled speeds of the conveyer belt 22 or each of print modes: monochrome print mode, color print mode, thick paper print mode, and OHP print mode.

When the print operation is started again after completion of the previous one, the correction value of the speed of the conveyer belt 22 is determined in the following manner. The speed of the conveyer belt 22 after completion of the print operation is gradually decreased, as described above, under the thermal influence of the fixing device 32. The correction value is, therefore, determined so as to increase as a function of the print-off time. Specifically, one of values, as indicated by a solid line in FIG. 13, approximating a curve, as indicated by a broken line, which increases from zero (0) to $A_0$ as the print-off time increases from zero (0).

Figure 13:
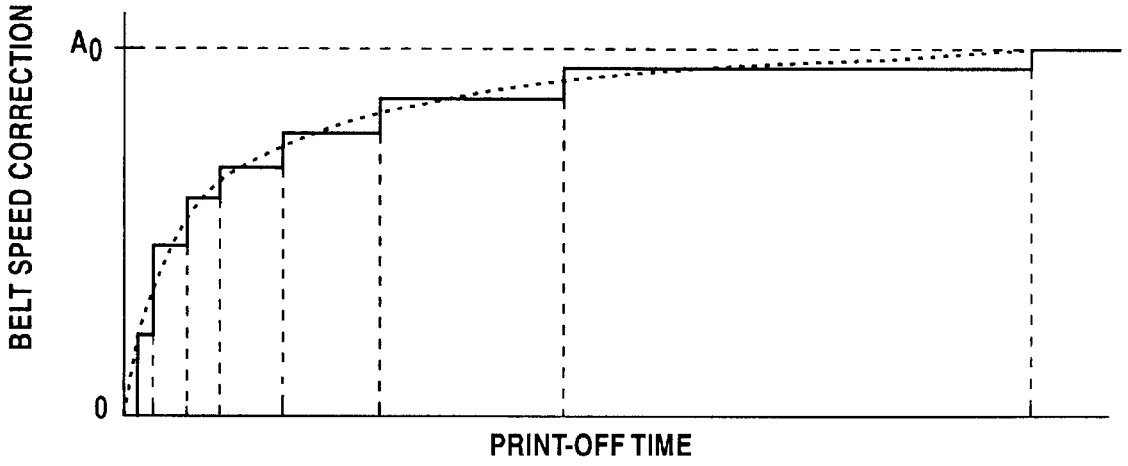
FIG. 13 is a graph which shows how to determine approximate values of belt speed correction values when a print operation is started again.

The correction values in FIG. 13 bear a one-to-one correspondence to the elapsed time (i.e., an offset that is the thermal influence of the previous print operation expressed in time) from the start of the conveyer belt 22 defined along the abscissa axis of FIG. 12. Therefore, each of the correction values is, as shown in table 2 (FIG. 23), defined as the elapsed time from the start of the conveyer belt 22 corresponding to the print-off time. The elapsed time is, however, counted from a value other than zero (0) at the start of the conveyer belt 22, as shown in FIG. 11.

Figure 14:
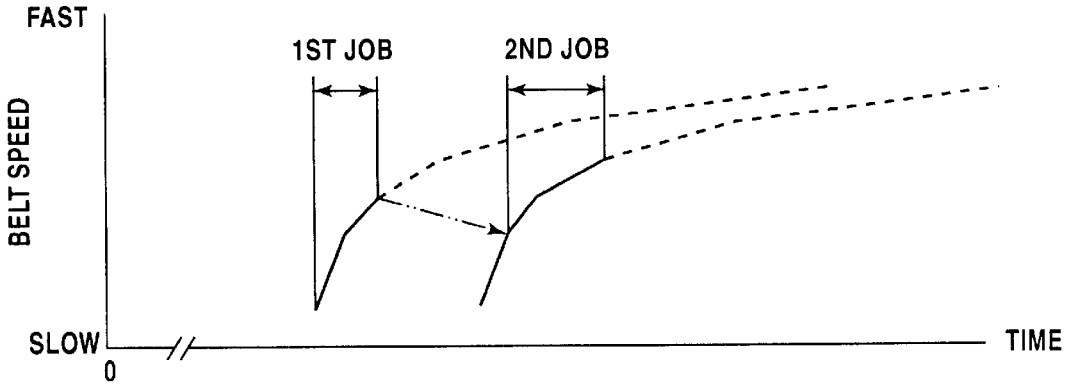
FIG. 14 is a graph which shows a change in speed of a conveyer belt after a print operation is resumed within a relatively short time.
Figure 15:
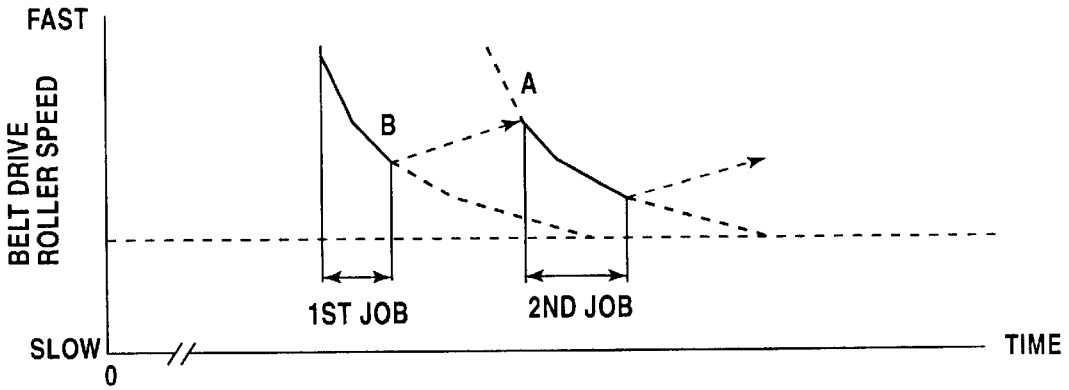
FIG. 15 is a graph which shows a change in speed of a conveyer belt when corrected after a print operation is resumed within a relatively short time.

The operations described so far are performed in the case where a color shift is saturated at the beginning of the print-off time, that is, where the speed of the conveyer belt 22 has been saturated in a print job performed immediately before the print-off time is measured. The print job is, however, often finished, as shown in FIG. 14, before the speed of the conveyer belt 22 is saturated (broken lines in FIG. 14 indicate the speed of the conveyer belt 22 when the print operations are performed continuously). In such a case, if the second print job is started again immediately after completion of the first print job (e.g., within several minutes), the speed of the conveyer belt 22 when the second print job is started is almost equal to that when the first print job is finished, but a change in speed of the conveyer belt 22 when the second print job is started increases as the print-off time increases. Therefore, a count value of the print-off time is, as shown in FIG. 15, corrected in view of a condition at the end of the first print job. Specifically, an initial count value of the print time at point A in FIG. 15 is set to a time corresponding to a read-out position in a print time initial count value index table 3 which is determined by a count value of the print time at point B and the time intervals between A and B (i.e., the print-off time).

The print time initial count value index table 3 (FIG. 24) will be explained below by means of example. In table 3, the print time indicates the time during which a previous print job is performed. The print-off time count indicates a time interval between the previous print job and a subsequent print job.

If a previous print job was executed in the color print mode for 20 sec., one of the print-off time counts in a row of print time group No. 5 is selected. In this case, even after he print-off time until the current print job exceeds 90 minutes, a print-off time count of zero (0) is selected. Next, one of the print times in the color print mode listed in a row of the print time group number equal to the selected print-off time count is selected as an initial value of a print time count when the current print job is started. In this case, three (3) sec. is selected. If a previous print job was executed in the color print mode for 54 sec., one of the print-off time counts listed in a row of print time group No. 11 is selected. If the print-off time until the current print job is one (1) minute, a print-off time count of seven (7) is selected. Next, a maximum one of the print times in the color print mode listed in a row of the print time group number of 7, i.e., 32 is selected as an initial value of a print time count when the current print job is started. The same operation is performed in each of the monochrome print, thick paper print, and OHP print mode.

Figure 16:
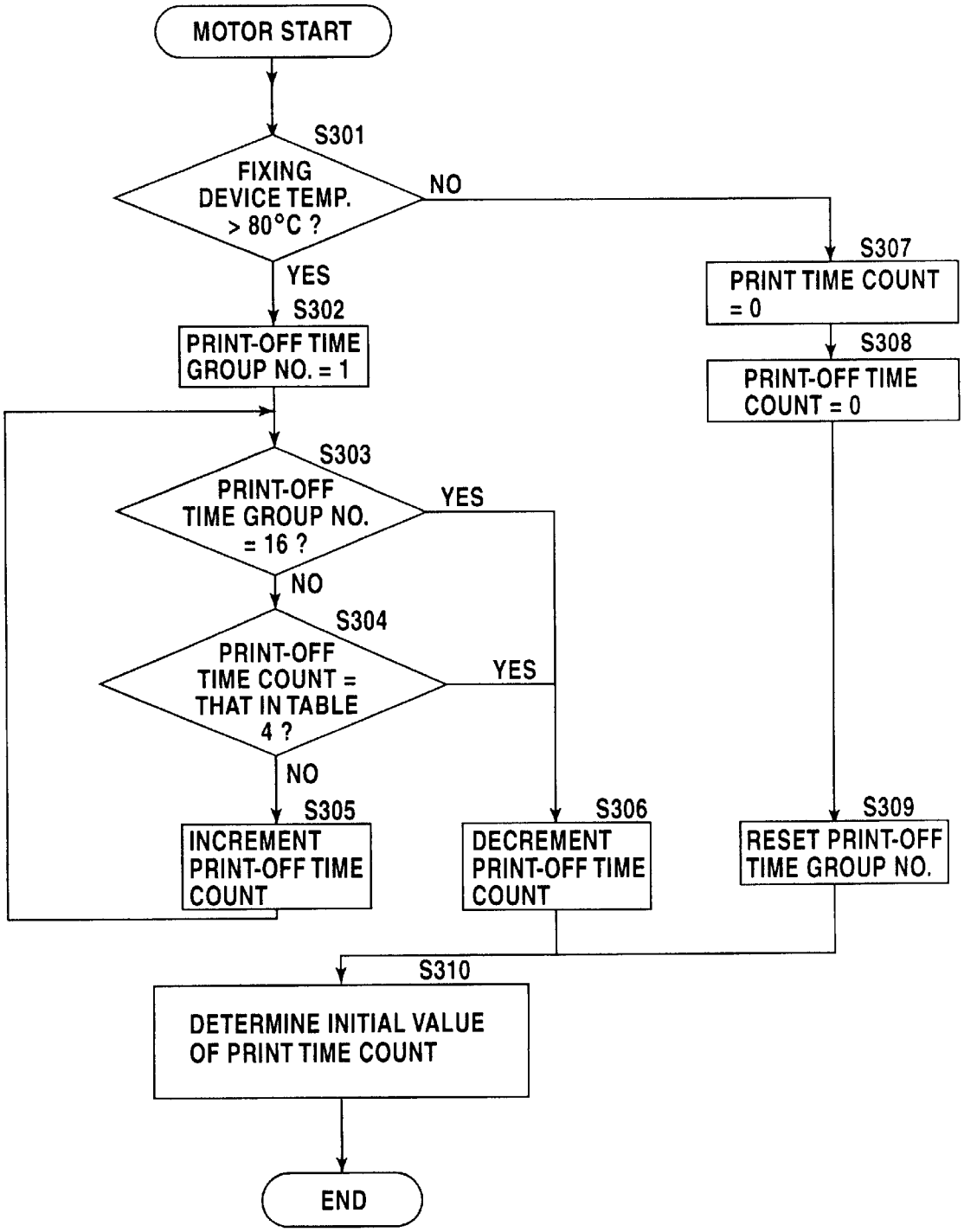
FIG. 16 is a flowchart of a program performed to initialize a print time count.

FIG. 16 shows a flowchart of a program to initialize the print time count based on the print-off time listed in table 3 which is performed upon turning on of the motor 70.

After entering the program, the routine proceeds to step S301 wherein it is determined whether the temperature of the fixing device 32 is higher than 80° C. or not. If a YES answer is obtained, then the routine proceeds to step S302 wherein the print-off time group number is set to one (1). The routine proceeds to step S303 wherein it is determined whether the print-off time group number is sixteen (16) or not, that is, whether the end of table 3 is reached or not. If a NO answer is obtained, then the routine proceeds to step S304 wherein it is determined whether the print-off time count is identical with that indicated in table 4 (FIG. 25) by the print-off time group number or not. If a NO answer is obtained, then the routine proceeds to step S305 wherein the print-off time group number is incremented by one (1) and returns back to step S303. Subsequently, steps 303 to 305 are repeated until the print-off time group number reaches 16 or the print-off time count is identical with that indicated in table 4 by the print-off time group number.

If a YES answer is obtained in step S303 meaning that the print-off time group number has reached 16 or if a YES answer is obtained in step S304 meaning that the print-off time count has become identical with that indicated in table 4 by the print-off time group number, then the routine proceeds to step S306 wherein the print-off time group number is decremented by one (1).

If a NO answer is obtained in step S301 meaning that the temperature of the fixing device 32 is higher than 80° C., then the routine proceeds to step S307 wherein the print time count is reset to zero (0). The routine proceeds to step S308 wherein the print-off time count is reset to zero (0). Specifically, the speed control circuit 40*c* determines that the image-forming device 10 has started in a cold condition and resets the print-off time count and print time count measured by the timer 40*a* to zero (0). The routine proceeds to step S309 wherein the print-off time group number is set to zero (0).

After step S306 or S309, the routine proceeds to step S310 wherein an initial value of the print time count is set to one of values listed in a print time correction table 5 (FIG. 26) which is located by the print-off time group number and the print time group number.

Figure 17:
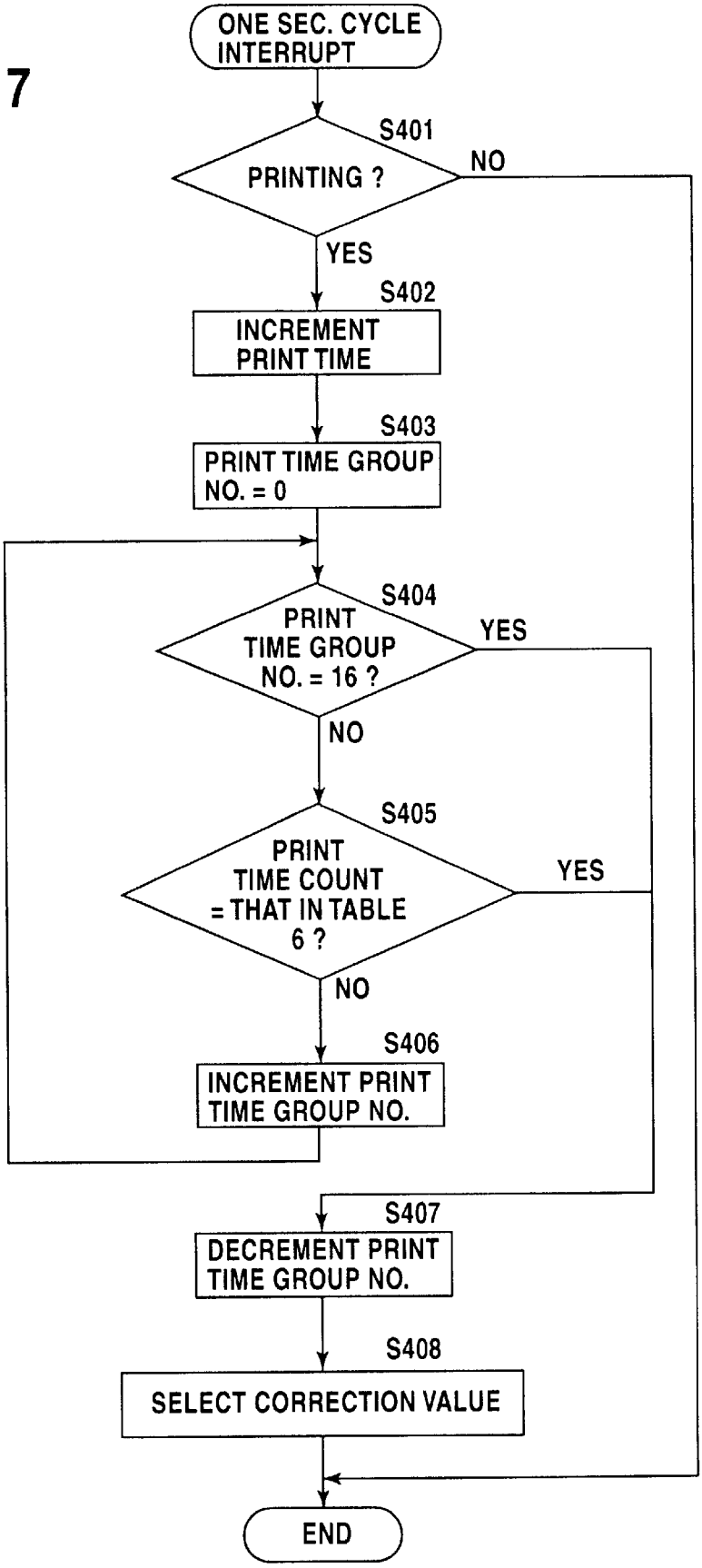
FIG. 17 is a flowchart of a program performed to determine a correction value.

FIG. 17 shows a flowchart of a program performed at regular intervals of one (1) sec. to determine the correction value for correcting the speed of the conveyer belt 22.

After entering the program, the routine proceeds to step S401 wherein the print operation is being performed or not. If a NO answer is obtained, the routine terminates. Alternatively, if a YES answer is obtained, then the routine proceeds to step S402 wherein the print time count is incremented by one (1). The routine proceeds to step S403 wherein the print time group number is set to zero (0). The routine proceeds to step S404 wherein it is determined whether the print-off time group number reaches sixteen (16) or not, that is, whether the end of table 3 is reached or not. If a NO answer is obtained, then the routine proceeds to step S405 wherein it is determined whether the print time count is identical with that indicated in table 6 (FIG. 27) by the print time group number or not. If a NO answer is obtained, then the routine proceeds to step S406 wherein the print time group number is incremented by one (1) and returns back to step S404. Subsequently, steps 404 to 406 are repeated until the print time group number reaches 16 or the print time count is identical with that indicated in table 6 by the print time group number.

If a YES answer is obtained in step S404 meaning that the print time group number has reached 16 or if a YES answer is obtained in step 405 meaning that the print time count has become identical with that indicated in table 6 by the print time group number, then the routine proceeds to step 407 wherein the print time group number is decremented by one (1). The routine proceeds to step S408 wherein one of correction values listed in table 7 (FIG. 28) which is indicated by the print time group number is selected.

Figure 18:
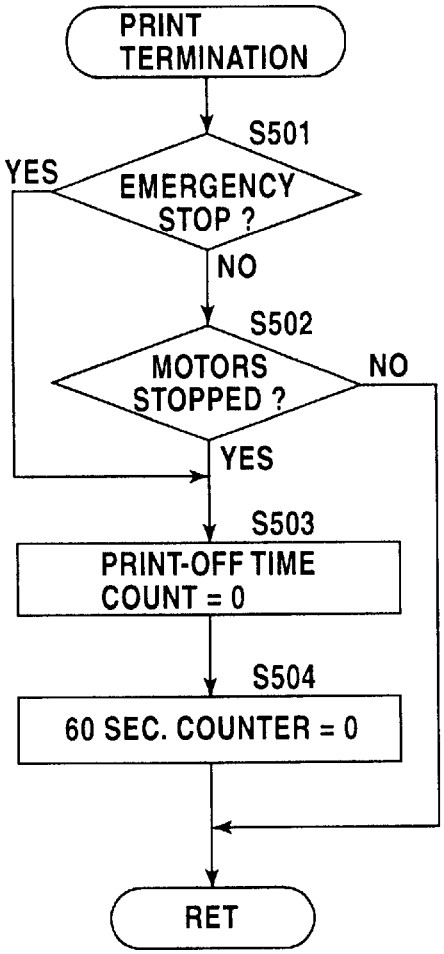
FIG. 18 is a flowchart of a program performed when a print operation is terminated.

FIG. 18 shows a flowchart of a program to terminate the print operation.

First, in step S501, it is determined whether an emergency stop request is made or not. If a NO answer is obtained, then the routine proceeds to step S502 wherein all motors are stopped or not. If a YES answer is obtained in step S501 or step S502, then the routine proceeds to step S503 wherein the print time count is reset to zero (0). The routine proceeds to step S504 wherein a 60-second counter is reset to zero (0) to initiate the print-off time count. If a NO answer is obtained meaning that all the motor are not stopped, then the routine terminates.

Figure 19:
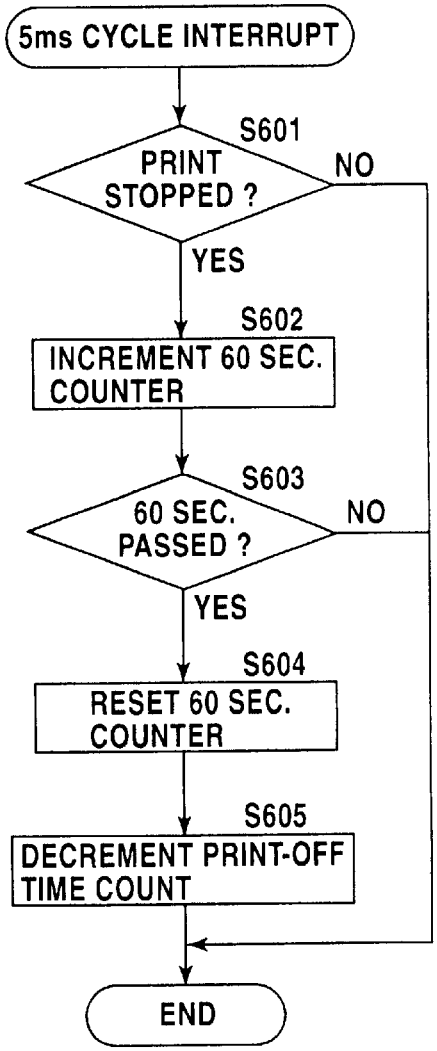
FIG. 19 is a flowchart of a program performed to handle a print-off time count.

FIG. 19 shows a flowchart of a program to handle the print-off time count which is performed by timer interrupt at regular intervals of 5 ms.

First, in step S601, it is determined whether the print operation is at rest or not. If a NO answer is obtained, then the routine terminates. Alternatively, if a YES answer is obtained, then the routine proceeds to step S602 wherein the 60-second counter is incremented by one (1). The routine proceeds to step S603 wherein it is determined whether 60 seconds have passed or not. If a NO answer is obtained, then the routine terminates. Alternatively, if a YES answer is obtained, then the routine proceeds to step S604 wherein the 60-second counter is reset to zero (0). The routine proceeds to step S605 wherein the print-off time count is incremented by one (1).

By performing the above described operations, the timer 40*a* measures the elapsed time from the turning on of the power or release of the sleep mode, the print-off time, and the print time. The speed control circuit 40*c* monitors the times measured by the timer 40*a* and estimates and corrects the speed of the conveyer belt 22. This enables formation of color images without any color shifts and decrease in throughput.

Figure 20:
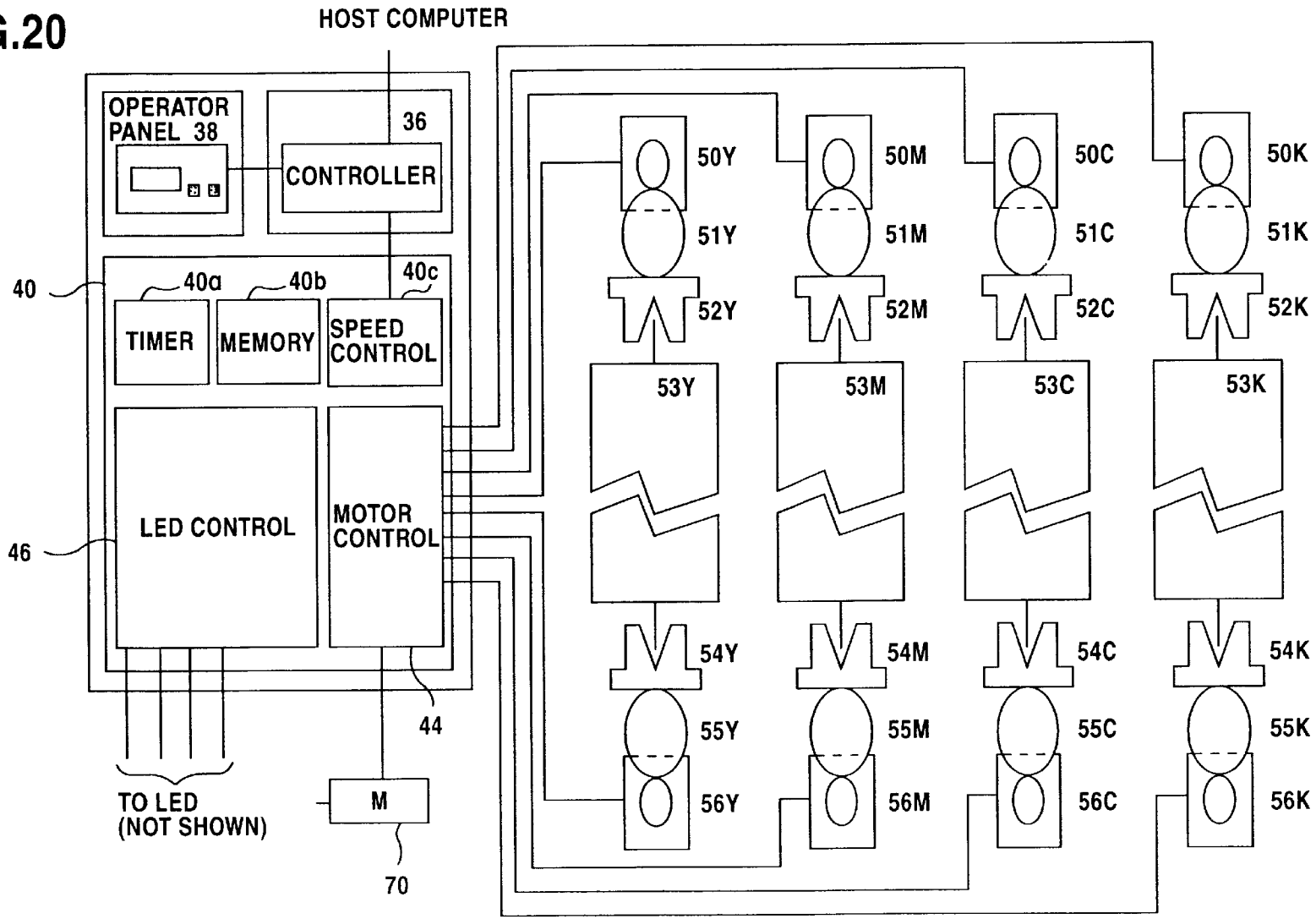
FIG. 20 is a block diagram which shows an image-forming device according to the second embodiment of the invention.

FIG. 20 shows an image-forming device according to the second embodiment of the invention which is different from the first embodiment in that intervals between image-transferring units are corrected instead of the correction of the belt speed. The same reference numbers as employed in the first embodiments refer to the same parts, and explanation thereof in detail will be omitted here.

The image-transferring units 53Y, 53M, 53C, and 53K are supported by the positioning members 52Y, 54Y, 52M, 52C, 54C, 52K, and 54K. The positioning members 52Y, 54Y, 52M, 54M, 52C, 54C, 52K, and 54K are installed on a device casing (not shown) so as to be movable only in a lateral direction, as viewed in the drawing. Portions of the positioning members opposite portions supporting the image-transferring units are provided with gears connected mechanically to image-transferring unit drive motors 50Y, 56Y, 50M, 56M, 50C, 56C, 50K, and 56K through intermediate gears 51Y, 55Y, 51M, 55M, 51C, 55C, 51K, and 55K.

When the image-transferring unit drive motor 50Y is rotated in a counterclockwise direction, as viewed in the drawing, and the image-transferring unit drive motor 56Y is rotated in a clockwise direction through the same angular steps as those of the image-transferring unit drive motor 50Y, the positioning members 52Y and 54Y are moved in parallel in the left direction to shift the image-transferring unit 53Y away from the image-transferring units 53M, 53C, and 53K. In other words, intervals between the image-transferring unit 53Y and the other three image-transferring units 53M, 53C, and 53K are increased, respectively. Conversely, when the image-transferring unit drive motor 50Y is rotated in the clockwise direction, and the image-transferring unit drive motor 56Y is rotated in the counterclockwise direction, the positioning members 52Y and 54Y are moved in parallel in the right direction to shorten the intervals between the image-transferring unit 53Y and the other three image-transferring units 53M, 53C, and 53K.

Figure 21:
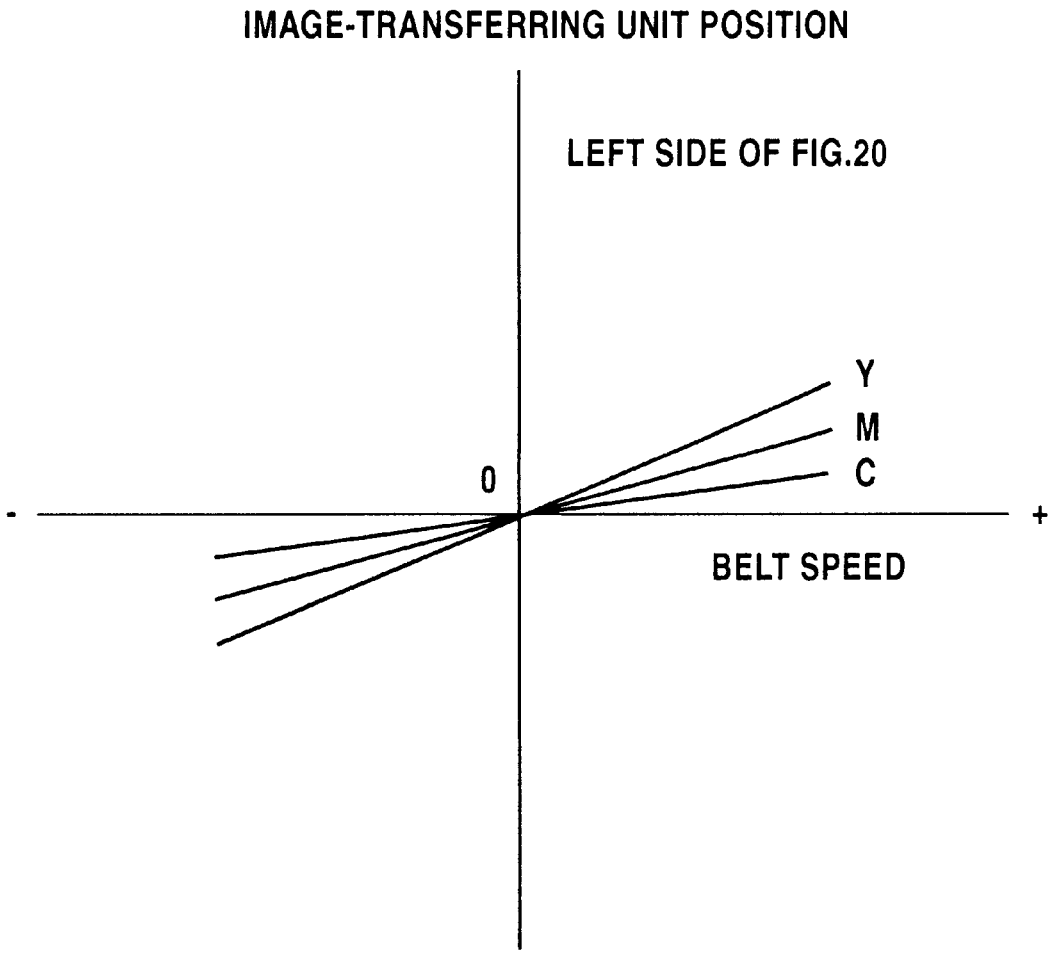
FIG. 21 is an illustration which shows how to determine positions of image-transferring units.

The image-transferring device of this embodiments measures, similar to the first embodiment, the print-off time, the print time, etc. through the timer 40*a* and estimates the belt temperature to estimate the belt speed based on the belt temperature. The image-transferring device determines target positions of the image-transferring units 53Y, 53M, 53C, and 53K based on the estimated belt speed using speed-to-position relations, as shown in FIG. 21 and moves the image-transferring units 53Y, 53M, 53C, and 53K in the above manner to the target positions. In the shown case, the location of the image-transferring unit 53K is defined as a reference position. Only the image-transferring units 53Y, 53M, and 53C are, thus, moved.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. An image-forming apparatus comprising:

a conveyer belt transporting a print sheet;

image-transferring units provided one for each of a plurality of primary colors, said image-transferring units being arrayed in a direction of transport of the print sheet to transfer primary-colored images to the print sheet on said conveyer belt, respectively;

a timer measuring an operating time of the apparatus; and control means for controlling positions where the images are formed by said image-transferring units on the print sheet conveyed by said conveyer belt based on the time measured by said timer, wherein said control means changes a correction amount of said positions depending on a magnitude of the time measured by said timer.

2. An image-forming apparatus comprising:

a conveyer belt transporting a print sheet;

image-transferring units provided one for each of a plurality of primary colors, said image-transferring units being arrayed in a direction of transport of the print sheet to transfer primary-colored images to the print sheet on said conveyer belt, respectively;

a timer measuring at least one of an elapsed time from turning on of power, an elapsed time from release of a sleep mode, a print-off time, and a print time; and control means for controlling a belt speed based on either or any more than two of the times measured by said timer.

3. An image-forming apparatus comprising:

a conveyer belt transporting a print sheet;

image-transferring units provided one for each of a plurality of primary colors, said image-transferring units being arrayed in a direction of transport of the print sheet to transfer primary-colored images to the print sheet on said conveyer belt, respectively;

a timer measuring at least one of an elapsed time from turning on of power, an elapsed time from release of a sleep mode, a print-off time, and a print time; and control means for controlling an image-transferring cycle of each of said image-transferring units based on either or any more than two of the times measured by said timer.

4. An image-forming apparatus comprising:

a conveyer belt transporting a print sheet;

image-transferring units provided one for each of a plurality of primary colors, said image-transferring units being arrayed in a direction of transport of the print sheet to transfer primary-colored images to the print sheet on said conveyer belt, respectively;

a timer measuring at least one of an elapsed time from turning on of power, an elapsed time from release of a sleep mode, a print-off time, and a print time; and control means for controlling intervals between said image-transferring units based on either or any more than two of the times measured by said timer.

5. An image-forming apparatus comprising:

a conveyer belt transporting a print sheet;

image-transferring units provided one for each of a plurality of primary colors, said image-transferring units being arrayed in a direction of transport of the print sheet to transfer primary-colored images to the print sheet on said conveyer belt, respectively;

a timer measuring at least one of an elapsed time from turning on of power, an elapsed time from release of a sleep mode, a print-off time, and a print time; and control means for controlling an image transfer start timing of each of said image-transferring units based on either or any more than two of the times measured by said timer.

6. An image-forming apparatus as set forth in any one of claims 1 to 5, wherein when a temperature of a fixing device is lower than a set temperature, said control means drives said conveyer belt for a constant period of time prior to a color shift detecting operation.

7. An image-forming apparatus, as set forth in claim 6, wherein driving of said conveyer belt is performed intermittently.

8. An image-forming apparatus as set forth in any of claims 1 to 5, wherein when a temperature of a fixing device is lower than a set temperature, a color shift detecting operation is performed as is.

9. An image forming apparatus as set forth in any one of claims 2 to 5, wherein when a temperature of a fixing device is lower than a set temperature, the elapsed time from turning on of power or release of the sleep mode is set to zero (0), the print-off time is set to infinity, a previous print time is set to zero (0), and control of said control means is performed.

10. An image forming apparatus as set forth in any one of claims 2 to 5, wherein said timer has a clock circuit supported at least by a backup battery or structure reading therein information on an external time, based on this structure, after the power is turned on or the release of the sleep mode, said control means calculates said print-off time in a power-off condition from a final printing end time stored in a nonvolatile memory and performs each control.

11. An image forming apparatus as set forth in any one of claim 2, wherein said control means changes a correction amount of said positions depending on a magnitude of the time measured by said timer.

12. An image forming apparatus as set forth in any one of claim 3, wherein said control means changes a correction amount of said positions depending on a magnitude of the time measured by said timer.

13. An image forming apparatus as set forth in any one of claim 4, wherein said control means changes a correction amount of said positions depending on a magnitude of the time measured by said timer.

14. An image forming apparatus as set forth in any one of claim 5, wherein said control means changes a correction amount of said positions depending on a magnitude of the time measured by said timer.

15. An image-forming apparatus comprising:

a conveyer belt transporting a print sheet;

image-transferring units provided one for each of a plurality of primary colors, said image-transferring units being arrayed in a direction of transport of the print sheet to transfer primary-colored images to the print sheet on said conveyer belt, respectively;

a timer measuring at least a print-off time and a print time;

storage means for storing therein a first belt speed change curve for obtaining a belt speed estimated as a function of the print time and a second belt speed change curve for obtaining a belt speed estimated as a function of the print-off time when a print operation is started again after a lapse of the print-off time; and controlling means determining a belt speed corresponding to a previous print time from said first belt speed change curve based on the print-off time and the print time measured by said timer, sets a point on the second belt speed change curve matching the determined belt speed to a count start point of the print-off time to further determine a belt speed on the second belt speed change curve after a lapse of the print-off time, and considers the determined belt speed as one after a lapse of a print time corresponding to the belt speed on the first belt speed change curve in the current print operation to control the belt speed.

16. An image-forming apparatus as set forth in claim 15, wherein said storage means has a table defining first belt speed correction values and second belt speed correction values corresponding to the first belt speed change curve and the second belt speed change curve, and wherein said controlling means determines a first belt speed correction value from said table which corresponds to the previous print time, determines a point on which a second belt speed correction value matching the first belt speed correction value is located as the count start point to further determine the second belt speed correction value on said table after a lapse of the print-off time, and considers the determined second belt speed correction value as one after a lapse of a print time corresponding to the first belt speed correction value on said table in the current print operation to perform control from that time.

17. An image-forming apparatus comprising:

a conveyer belt transporting a print sheet;

image-transferring units provided one for each of a plurality of primary colors, said image-transferring units being arrayed in a direction of transport of the print sheet to transfer primary-colored images to the print sheet on said conveyer belt, respectively;

a timer measuring at least a print-off time and a print time;

storage means for storing therein a first belt speed change curve for obtaining a belt speed estimated as a function of the print time and a second belt speed change curve for obtaining a belt speed estimated as a function of the print-off time when a print operation is started again after a lapse of the print-off time; and controlling means determining a belt speed corresponding to a previous print time from said first belt speed change curve based on the print-off time and the print time measured by said timer, sets a point on the second belt speed change curve matching the determined belt speed to a count start point of the print-off time to further determine a belt speed on the second belt speed change curve after a lapse of the print-off time, and considers the determined belt speed as one after a lapse of a print time corresponding to the belt speed on the first belt speed change curve in the current print operation to control an image-transferring cycle of each said image-transferring units.

18. An image-forming apparatus as set forth in claim 17, wherein said storage means has a table defining first image-transferring cycle correction values and second image-transferring cycle correction values corresponding to the first belt speed change curve and the second belt speed change curve, and wherein said controlling means determines a first image-transferring correction value from said table which corresponds to the previous print time, determines a point on which a second image-transferring correction value matching the first image-transferring correction value is located as the count start point to further determine the second image-transferring correction value on said table after a lapse of the print-off time, and considers the determined second image-transferring correction value as one after a lapse of a print time corresponding to the first image-transferring correction value on said table in the current print operation to perform control from that time.

19. An image-forming apparatus comprising:

a conveyer belt transporting a print sheet;

image-transferring units provided one for each of a plurality of primary colors, said image-transferring units being arrayed in a direction of transport of the print sheet to transfer primary-colored images to the print sheet on said conveyer belt, respectively;

a timer measuring at least a print-off time and a print time;

storage means for storing therein a first belt speed change curve for obtaining a belt speed estimated as a function of the print time and a second belt speed change curve for obtaining a belt speed estimated as a function of the print-off time when a print operation is started again after lapse of the print-off time; and controlling means determining a belt speed corresponding to a previous print time from said first belt speed change curve based on the print-off time and the print time measured by said timer, sets a point on the second belt speed change curve matching the determined belt speed to a count start point of the print-off time to further determine a belt speed on the second belt speed change curve after a lapse of the print-off time, and considers the determined belt speed as one after a lapse of a print time corresponding to the belt speed on the first belt speed change curve in the current print operation to control intervals between said image-transferring units.

20. An image-forming apparatus as set forth in claim 19, wherein said storage means has a table defining first image-transferring unit-to-image-transferring unit interval correction values and second image-transferring unit-to-image-transferring unit interval correction values corresponding to the first belt speed change curve and the second belt speed change curve, and wherein said controlling means determines a first image-transferring unit-to-image-transferring unit interval correction value from said table which corresponds to the previous print time, determines a point on which a second image-transferring unit-to-image-transferring unit correction value matching the first image-transferring unit-to-image-transferring unit correction value is located as the count start point to further determine the second image-transferring unit-to-image-transferring unit correction value on said table after a lapse of the print-off time, and considers the determined second image-transferring unit-to-image-transferring unit correction value as one after a lapse of a print time corresponding to the first image-transferring unit-to-image-transferring unit correction value on said table in the current print operation to perform control from that time.

21. An image-forming apparatus comprising:

a conveyer belt transporting a print sheet;

image-transferring units provided one for each of a plurality of primary colors, said image-transferring units being arrayed in a direction of transport of the print sheet to transfer primary-colored images to the print sheet on said conveyer belt, respectively;

a timer measuring at least a print-off time and a print time;

storage means for storing therein a first belt speed change curve for obtaining a belt speed estimated as a function of the print time and a second belt speed change curve for obtaining a belt speed estimated as a function of the print-off time when a print operation is started again after a lapse of the print-off time; and controlling means determining a belt speed corresponding to a previous print time from said first belt speed change curve based on the print-off time and the print time measured by said timer, sets a point on the second belt speed change curve matching the determined belt speed to a count start point of the print-off time to further determine a belt speed on the second belt speed change curve after a lapse of the print-off time, and considers the determined belt speed as one after a lapse of a print time corresponding to the belt speed on the first belt speed change curve in the current print operation to control an image-transferring start timing of each of said image-transferring unit.

22. An image-forming apparatus as set forth in claim 21, wherein said storage means has a table defining first image-transferring start timing correction values and second image-transferring start timing correction values corresponding to the first belt speed change curve and the second belt speed change curve, and wherein said controlling means determines a first image-transferring start timing correction value from said table which corresponds to the previous print time, determines a point on which a second image-transferring start timing correction value matching the first image-transferring start timing correction value is located as the count start point to further determine the second image-transferring start timing correction value on said table after a lapse of the print-off time, and considers the determined second image-transferring start timing correction value as one after a lapse of a print time corresponding to the first image-transferring start timing correction value on said table in the current print operation to perform control from that time.

23. An image-forming apparatus comprising:

a conveyer belt transporting a print sheet;

image-transferring units provided one for each of a plurality of primary colors, said image-transferring units being arrayed in a direction of transport of the print sheet to transfer primary-colored images to the print sheet on said conveyer belt, respectively;

a timer measuring an operating time of the apparatus; and control means for controlling positions where the images are formed by said image-transferring units on the print sheet conveyed by said conveyer belt based on the time measured by said timer, wherein when a temperature of a fixing device is lower than a set temperature, an elapsed time from turning on of power or release of a sleep mode is set to zero (0), a print-off time is set to infinity, a previous print time is set to zero (0), and control of said control means is performed.

24. An image-forming apparatus comprising:

a conveyer belt transporting a print sheet;

image-transferring units provided one for each of a plurality of primary colors, said image-transferring units being arrayed in a direction of transport of the print sheet to transfer primary-colored images to the print sheet on said conveyer belt, respectively;

a timer measuring an operating time of the apparatus; and control means for controlling positions where the images are formed by said image-transferring units on the print sheet conveyed by said conveyer belt based on the time measured by said timer, wherein when a temperature of a fixing device is lower than a set temperature, said control means drives said conveyer belt for a constant period of time prior to a color shift detecting operation.

25. An image-forming apparatus comprising:

a conveyer belt transporting a print sheet;

image-transferring units provided one for each of a plurality of primary colors, said image-transferring units being arrayed in a direction of transport of the print sheet to transfer primary-colored images to the print sheet on said conveyer belt, respectively;

a timer measuring an operating time of the apparatus; and control means for controlling positions where the images are formed by said image-transferring units on the print sheet conveyed by said conveyer belt based on the time measured by said timer, wherein when a temperature of a fixing device is lower than a set temperature, said control means drives said conveyer belt for a constant period of time prior to a color shift detecting operation, wherein driving of said conveyer belt is performed intermittently.

26. An image-forming apparatus comprising:

a conveyer belt transporting a print sheet;

image-transferring units provided one for each of a plurality of primary colors, said image-transferring units being arrayed in a direction of transport of the print sheet to transfer primary-colored images to the print sheet on said conveyer belt, respectively;

a timer measuring an operating time of the apparatus; and control means for controlling positions where the images are formed by said image-transferring units on the print sheet conveyed by said conveyer belt based on the time measured by said timer, wherein when a temperature of a fixing device is lower than a set temperature, a color shift detecting operation is performed as is.

27. An image-forming apparatus comprising:

a conveyer belt transporting a print sheet;

image-transferring units provided one for each of a plurality of primary colors, said image-transferring units being arrayed in a direction of transport of the print sheet to transfer primary-colored images to the print sheet on said conveyer belt, respectively;

a timer measuring an operating time of the apparatus; and control means for controlling positions where the images are formed by said image-transferring units on the print sheet conveyed by said conveyer belt based on the time measured by said timer, wherein said timer has a clock circuit supported at least by a backup battery or structure reading therein information on an external time, based on this structure, after the power is turned on or the release of a sleep mode, said control means calculates a print-off time in a power-off condition from a final printing end time stored in a nonvolatile memory and performs each control.

* * * * *